US011202526B2

(12) United States Patent
Juhasz

(10) Patent No.: US 11,202,526 B2
(45) Date of Patent: Dec. 21, 2021

(54) PORCH PIRACY PARCEL THEFT PREVENTION SYSTEM AND METHOD

(71) Applicant: Paul R. Juhasz, Houston, TX (US)

(72) Inventor: Paul R. Juhasz, Houston, TX (US)

( * ) Notice: Subject to any disclaimer, the term of this patent is extended or adjusted under 35 U.S.C. 154(b) by 49 days.

(21) Appl. No.: 16/726,036

(22) Filed: Dec. 23, 2019

(65) Prior Publication Data

US 2020/0196788 A1 Jun. 25, 2020

Related U.S. Application Data

(60) Provisional application No. 62/784,573, filed on Dec. 24, 2018.

(51) Int. Cl.

| | |
|---|---|
| ***A47G 29/124*** | (2006.01) |
| ***G08B 13/14*** | (2006.01) |
| ***G08B 1/08*** | (2006.01) |
| ***G08B 13/06*** | (2006.01) |

(52) U.S. Cl.
CPC ..... *A47G 29/124* (2013.01); *G08B 1/08* (2013.01); *G08B 13/06* (2013.01); *G08B 13/14* (2013.01); *A47G 2029/1257* (2017.08)

(58) Field of Classification Search
CPC ..... A47G 29/124; A47G 29/121; A47G 29/1214; A47G 2029/1257; A47G 2029/12105; A47G 2029/148; G08B 1/08; G08B 13/06; G08B 13/14; G08B 13/12
See application file for complete search history.

(56) References Cited

U.S. PATENT DOCUMENTS

| | | | | | |
|---|---|---|---|---|---|
| 3,935,994 | A * | 2/1976 | Darvishian | A47G 29/1225 | 232/36 |
| 4,287,514 | A * | 9/1981 | Wartman | G08B 5/36 | 200/61.63 |
| 4,382,540 | A * | 5/1983 | Kelly | A47G 29/12095 | 232/17 |
| 5,096,115 | A * | 3/1992 | Hassan | A47G 29/12095 | 232/17 |
| 5,915,618 | A * | 6/1999 | Gaudet | A47G 29/1209 | 232/33 |
| 5,917,411 | A * | 6/1999 | Baggarly | A47G 29/1212 | 340/569 |
| 6,155,715 | A * | 12/2000 | Lake | A47G 29/20 | 150/102 |

(Continued)

*Primary Examiner* — Hoi C Lau
(74) *Attorney, Agent, or Firm* — The Juhasz Law Firm

(57) ABSTRACT

A porch piracy parcel theft prevention system and method includes a delivery location apparatus configured for adaption to a building to receive a parcel, the delivery location apparatus including a sensor and a parcel locking mechanism. The sensor is configured to detect the presence of a delivered parcel placed into the line of sight of the parcel detecting sensor. The parcel locking mechanism is armed upon entry of a carrier code and disarmed upon entry of a user code. When armed, the parcel locking mechanism is configured to trigger an alarm when the parcel detected locking mechanism detects removal of the parcel from the line of sight of the parcel detecting sensor. When disarmed, the package may be removed from the line of sight of the parcel detecting sensor without tripping the alarm. Among other uses, helps prevent parcel theft from single family dwellings.

38 Claims, 22 Drawing Sheets

(56) References Cited

U.S. PATENT DOCUMENTS 6,234,388 B1 * 5/2001 Taylor ..... A47G 29/12095 232/47
6,318,628 B1 * 11/2001 Pangburn ..... A47G 29/1209 232/17
6,719,195 B2 * 4/2004 Farentinos ..... A47G 29/22 232/45
6,722,561 B1 * 4/2004 Thomas ..... G09F 7/08 232/39
6,974,074 B1 * 12/2005 Watts ..... A47G 29/124 232/45
7,100,816 B2 * 9/2006 Offenbacher .... A47G 29/12095 232/45
7,123,147 B2 * 10/2006 Engel ..... A47G 29/12095 340/569
7,182,245 B1 * 2/2007 Nieto ..... A47G 29/12095 232/45
7,222,779 B1 * 5/2007 Pineda-Sanchez ..... A47G 29/1214 232/36
7,249,705 B2 * 7/2007 Dudley ..... A47G 29/141 232/45
7,252,220 B1 * 8/2007 Shreve ..... A47G 29/124 232/45
7,295,110 B2 * 11/2007 Mercier ..... G07F 17/12 340/545.1
7,441,696 B2 * 10/2008 Bolles ..... E05B 77/44 232/45
7,448,531 B1 * 11/2008 Bolles ..... A47G 29/1216 232/39
7,607,569 B2 * 10/2009 Van Rossum .... A47G 29/12095 232/48
7,843,340 B2 * 11/2010 Davis ..... A47G 29/1214 340/569
7,854,374 B2 * 12/2010 Dudley ..... A47G 29/12095 232/45
7,938,314 B1 * 5/2011 Benesh ..... A47G 29/1214 232/45
7,988,035 B2 * 8/2011 Cox ..... A47G 29/12095 232/47
9,700,168 B1 * 7/2017 Evans ..... A47G 29/20
10,192,189 B2 1/2019 Bhatt
10,292,519 B1 * 5/2019 Sutton ..... A47G 29/1209
10,349,770 B1 * 7/2019 Cougar ..... H04N 5/2257
10,383,471 B1 * 8/2019 Barnes ..... A47G 29/20
10,517,417 B2 * 12/2019 Kutas ..... A47G 29/1251
10,643,413 B2 * 5/2020 Nandakumar ... G06K 19/06028
10,769,875 B2 * 9/2020 Arellano ..... H04N 7/188
10,891,811 B2 * 1/2021 Nakajima ..... G07C 9/00309
2002/0162883 A1 * 11/2002 Arvonio ..... G07B 17/00193 232/45
2003/0079129 A1 * 4/2003 Lindsay ..... G07F 17/12 713/176
2004/0211826 A1 * 10/2004 Jenkins ..... A47G 29/1209 232/17
2005/0253715 A1 * 11/2005 Awobue ..... A47G 29/1214 340/569
2005/0258226 A1 * 11/2005 Kujawa ..... A47G 29/121 232/17
2006/0152339 A1 * 7/2006 Mercier ..... G07G 1/0054 340/5.73
2010/0127063 A1 * 5/2010 Bolles ..... A47G 29/22 232/39
2013/0147626 A1 * 6/2013 Hammoud ..... A47G 29/1214 340/569
2014/0008246 A1 * 1/2014 Pfeiffer ..... A45C 11/00 206/1.5
2014/0346221 A1 11/2014 Pendergast
2015/0021386 A1 * 1/2015 Farentinos ..... A47G 29/30 232/43.3
2016/0066733 A1 * 3/2016 Gozar ..... G06Q 10/0833 232/18
2016/0230421 A1 * 8/2016 Cochran ..... G07C 9/00904
2017/0124510 A1 * 5/2017 Caterino ..... G07C 9/00896
2018/0047266 A1 2/2018 Siminoff
2018/0047267 A1 2/2018 Modestine
2018/0047268 A1 2/2018 Lemberger
2018/0070753 A1 * 3/2018 Eveloff ..... H04W 4/025
2018/0075718 A1 3/2018 Modestine
2018/0082554 A1 3/2018 Siminoff et al.
2018/0114420 A1 4/2018 Siminoff et al.
2018/0303265 A1 10/2018 Hearne
2018/0310714 A1 * 11/2018 Becker ..... A47C 11/00
2019/0000255 A1 * 1/2019 Dehner ..... A47G 29/20
2019/0038062 A1 * 2/2019 Sundaresan ..... A47G 29/1225
2019/0225375 A1 * 7/2019 Sena ..... A47G 29/141
2019/0244461 A1 8/2019 Nandakumar
2019/0248582 A1 * 8/2019 Nevison ..... A47G 29/30
2019/0259232 A1 * 8/2019 Nandakumar ..... G07F 17/10
2019/0320835 A1 * 10/2019 Dehner ..... B65D 50/02
2019/0340903 A1 11/2019 Siminoff et al.
2019/0356495 A1 11/2019 Dasarakothapalli et al.
2020/0012245 A1 * 1/2020 Marin Pulido ..... G06Q 50/28
2020/0128990 A1 * 4/2020 Pate ..... A47G 29/12095
2020/0134948 A1 * 4/2020 Sengstaken, Jr. .. G07C 9/00571
2020/0196788 A1 * 6/2020 Juhasz ..... G08B 13/06
2020/0265665 A1 * 8/2020 Nandakumar ... G06K 19/06037
2020/0302389 A1 * 9/2020 Wong ..... G07C 9/00309
2020/0323377 A1 * 10/2020 O'Connor ..... A47G 29/20
2021/0030185 A1 * 2/2021 Rogers ..... A47G 29/30

* cited by examiner

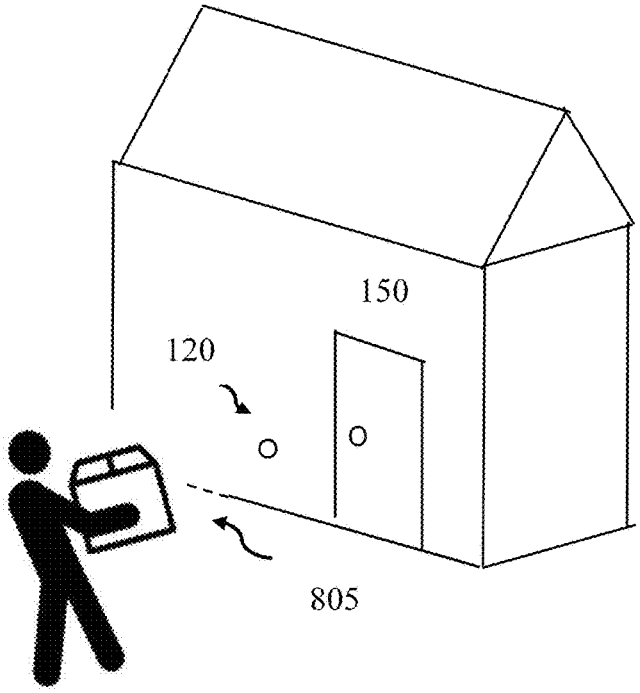
FIG. 8A1
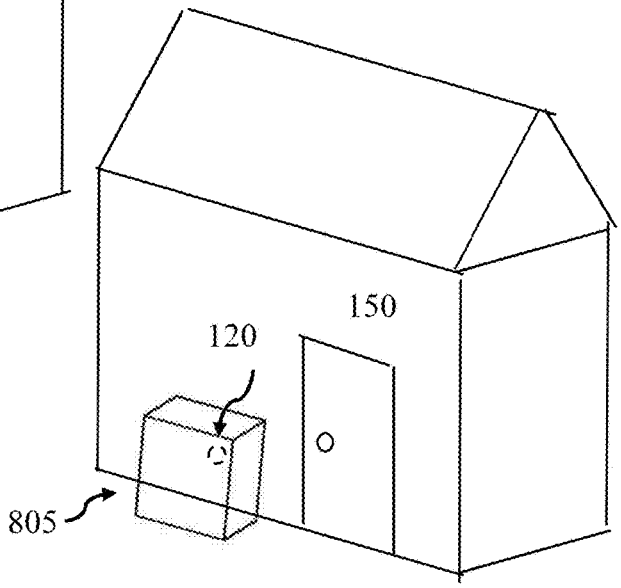
FIG. 8A2

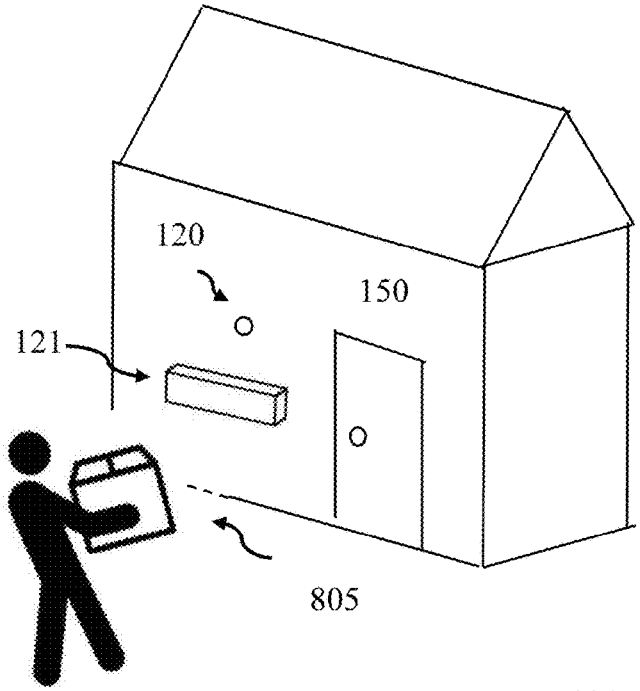
FIG. 8B1
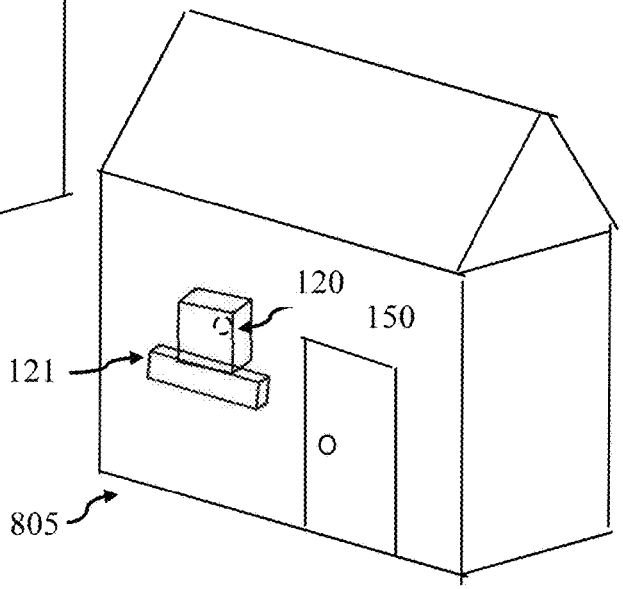
FIG. 8B2

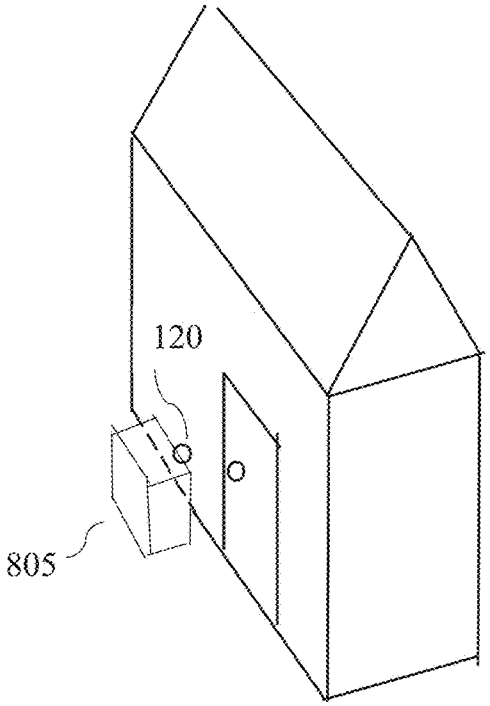
FIG. 9A1
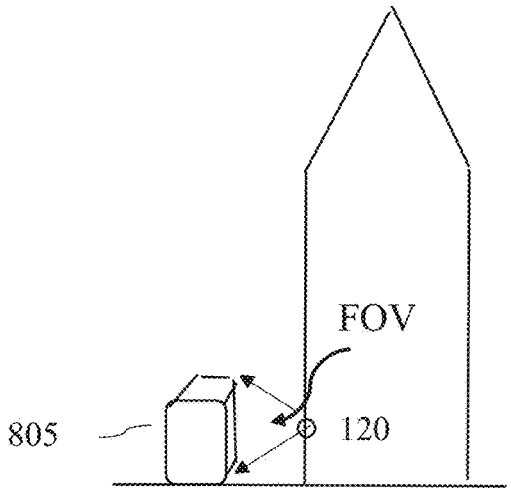
FIG. 9A2

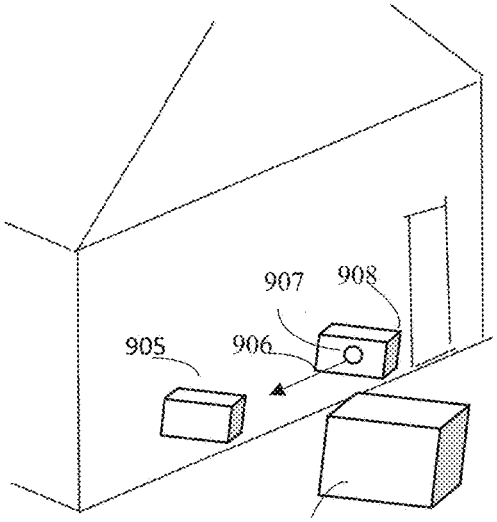
FIG. 9B1
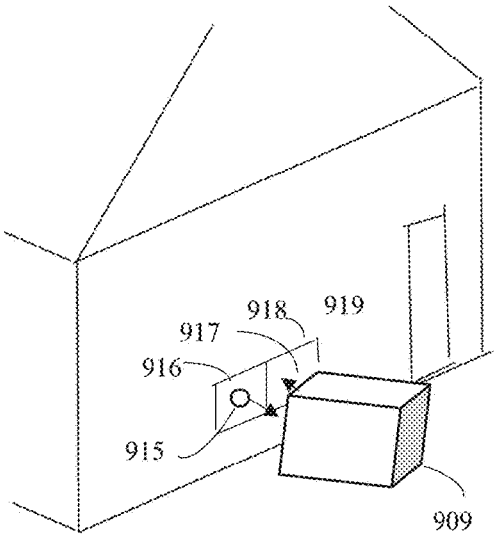
FIG. 9B2
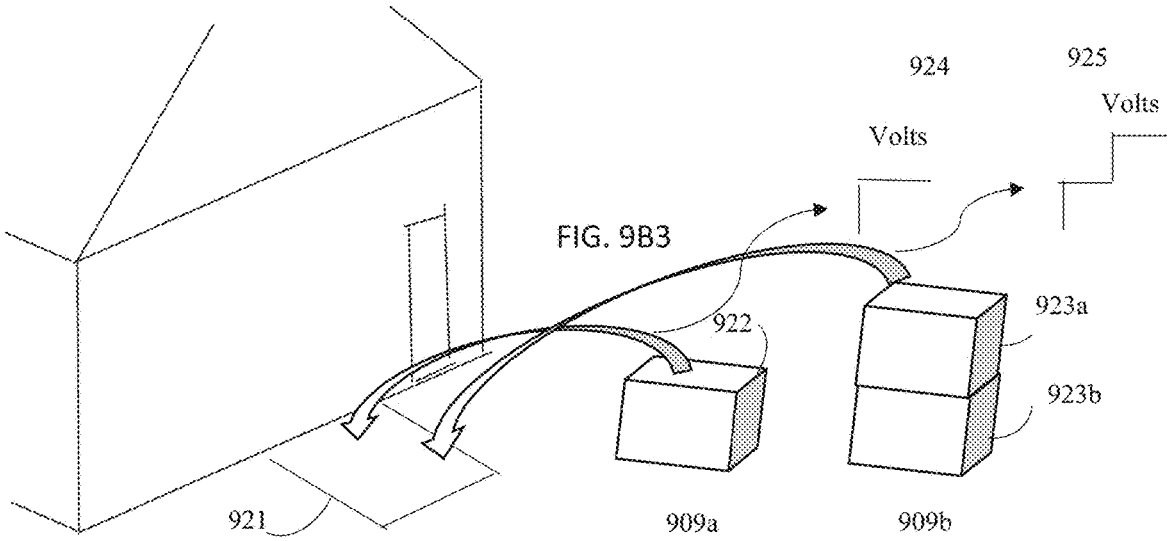
FIG. 9B3

| | | |
|---|---|---|
| Delivery Carrier 1402 | Code issued for delivery 1412 | Sets alarm 1422 |
| Homeowner 1403 | Code issued Homeowner 1413 | Disables alarm 1423 |

FIG. 14A

| | | |
|---|---|---|
| Seller 1401 | Code Issued at Sale 1411 | Sets Condition 1 for Alarm 1421 |
| Delivery Carrier 1402 | Code issued for delivery 1412 | Sets Condition 2 for Alarm 1422 |
| Homeowner 1403 | Code issued Homeowner 1413 | Disables Alarm 1423 |

FIG. 14B

| | | |
|---|---|---|
| Seller 1401 | Code Issued at Sale 1411 | Sets Condition 1 for Alarm 1421 |
| Delivery Carrier 1402 | Code issued for delivery 1412 | Sets Condition 2 for Alarm 1422 |
| Homeowner 1403 | Homeowner created code 1413 | Disables Alarm 1423 |

FIG. 14C

FIG. 14

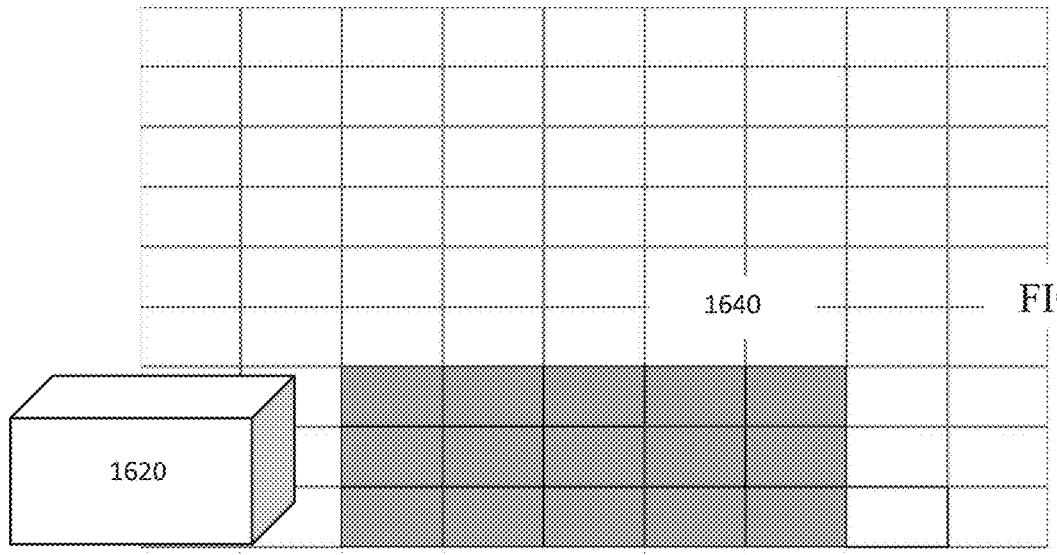
FIG. 16A
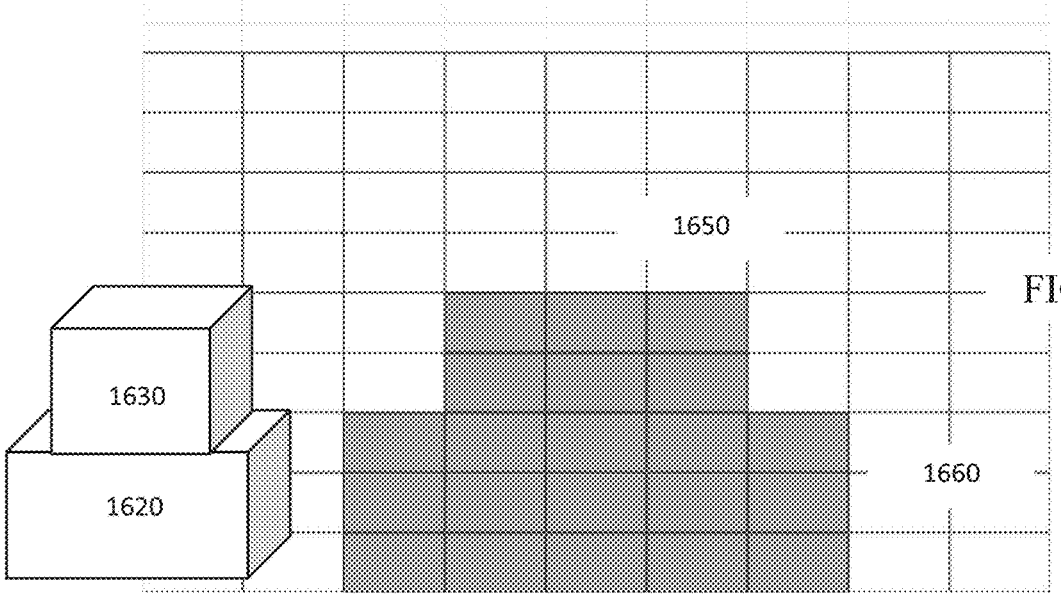
FIG. 16B
FIG. 16

PORCH PIRACY PARCEL THEFT PREVENTION SYSTEM AND METHOD

CLAIM TO PRIORITY

This application claims priority to and the benefit of the following pending application Ser. No. 62/784,573, filed Dec. 24, 2018, entitled "Delivered Package Theft Prevention System," the contents of which are hereby incorporated by reference in their entirety.

FIELD OF INVENTION

This disclosure is directed to delivered package theft prevention systems and methods and more particularly to a porch piracy delivered parcel theft prevention system and method.

BACKGROUND

With the growth in shopping on-line comes a growth in the deliveries of the purchased goods to a house, apartment, or building. Doorstep and building deliveries are on the rise.

This rise in the number of deliveries left at a house, apartment, or building has led to an increase in theft of the delivered goods. Where an owner or occupant of a house, apartment or building is not there at the time of delivery, the unattended delivery is a target for theft.

People who steal packages from people's doorsteps have become known as "porch pirates. They take packages left outside doors by UPS, FedEx, USPS, or other couriers.

Losses from thefts by porch pirates are not insignificant. The porch pirates often target valuable items like iPhones, iPads, small appliances, or luxury liquor or food items. They also steal prescription medicines. Stolen checks and documents containing personal identification may be used by porch pirates to commit identity theft.

While mail theft has been a felony under federal law, State governments are beginning to do something about it. Texas is leading the way, with a new law that went into effect in September, 2019 to crack down on porch pirates. The law mandates prison terms ranging between 180 days and ten years and fines of $4,000 to $10,000 for convicted porch pirates.

This disclosure addresses porch piracy with a theft prevention system and method for delivered packages.

SUMMARY

In one aspect, a porch piracy parcel theft prevention system and method includes a delivery location apparatus configured for attachment to a building to receive a parcel, the delivery location apparatus including a sensor and a parcel locking mechanism. The sensor is configured to detect the presence of a delivered parcel placed into the line of sight of the parcel detecting sensor. The parcel locking mechanism is armed upon entry of a carrier code and disarmed upon entry of a user code. When armed, the parcel locking mechanism is configured to trigger an alarm when the parcel detected locking mechanism detects removal of the parcel from the line of sight of the parcel detecting sensor. When disarmed, the package may be removed from the line of sight of the parcel detecting sensor without tripping the alarm. Among other uses, the system and method helps prevent parcel theft from single family dwellings.

In another aspect, a porch piracy delivered parcel theft prevention system includes a delivery location apparatus that is associated with and configured for attachment to a building to receive a parcel, the delivery location apparatus and a computing system implementing an order planning system. The delivery location apparatus includes a parcel detecting sensor, a parcel detected locking mechanism, a controller and a mounting mechanism. The parcel detecting sensor is configured to detect a parcel when the parcel is placed in a line of sight of the parcel detecting sensor. The parcel detected locking mechanism is configured to trigger an alarm when, in a locked position, the parcel detected locking mechanism detects removal of the parcel placed in the line of sight of the parcel detecting sensor. The controller is configured to control the parcel detected locking mechanism and includes an input device. The mounting mechanism is configured to attach the delivery location apparatus to an outside surface of the building to enable a user to retrieve an item from the line of sight of the parcel detecting sensor while the user is at the delivery location. The computing system implementing an order planning system includes one or more processors and a memory coupled to the one or more processors. The memory stores program instructions that when executed by the one or more processors cause the one or more processors to at least: receive from a user a selection of an item; identify a delivery location apparatus that the user has associated with the selection of the item; associate the delivery of the item with the delivery location apparatus so that the item will be delivered to the delivery location apparatus adapted to the building to enable the user to go to the delivery location and to remove the item from the line of sight of the parcel detecting sensor while the user is at the delivery location; and provide a lock code to enable the person delivering the parcel to the delivery location apparatus to activate the locking mechanism of the delivery location apparatus after placing the parcel in the line of sight of the parcel detecting sensor. The controller of the delivery location apparatus, in response to a receipt of the lock code from the person delivering the parcel to the delivery location apparatus after placing the parcel in the line of sight of the parcel detecting sensor, controls the locking mechanism to activate the locking mechanism of the delivery location apparatus to place the locking mechanism into a locked position. The removal of the parcel from the line of sight of the parcel detecting sensor while the locking mechanism is in the locked position triggers an alarm.

In another aspect, a method for preventing porch piracy delivered parcel theft, comprising the steps of: adapting a delivery location apparatus to a building to receive a parcel, and implementing an order planning system on a computing system, the computing system performing the steps of at least: receiving from a user a selection of an item; identifying a delivery location apparatus that the user has associated with the selection of the item; associating the delivery of the item with the delivery location apparatus so that the item will be delivered to the delivery location apparatus adapted to the building to enable the user to go to the delivery location and to remove the item from the line of sight of the parcel detecting sensor while the user is at the delivery location; and providing a lock code to enable the person delivering the parcel to the delivery location apparatus to activate the locking mechanism of the delivery location apparatus after placing the parcel in the line of sight of the parcel detecting sensor; receiving the lock code from the person delivering the parcel to the delivery location apparatus after placing the parcel in the line of sight of the parcel detecting sensor, activating the locking mechanism to place the locking mechanism into a locked position; and triggering an alarm when the parcel is removed from the line of sight of the parcel detecting sensor while the locking mechanism is in the locked position. The delivery location apparatus adapted to the building to receive a parcel, the delivery location apparatus including a parcel detecting sensor, a parcel detected locking mechanism, a controller, and a mounting mechanism. The parcel detecting sensor being configured to detect a parcel when the parcel is placed in a line of sight of the parcel detecting sensor. The parcel detected locking mechanism being configured to trigger an alarm when, in a locked position, the parcel detected locking mechanism detects removal of the parcel placed in the line of sight of the parcel detecting sensor; the controller being configured to control the parcel detected locking mechanism, the controller including an input device; and the mounting mechanism being configured to attach the delivery location apparatus to the building to enable a user to retrieve an item from the line of sight of the parcel detecting sensor while the user is at the delivery location.

DESCRIPTION OF DRAWINGS

FIGS. 8A1 and 8A2, collectively FIG. 8A; FIGS. 8B1 and 8B2, collectively FIG. 8B;

FIGS. 9A1 and 9A2, collectively FIG. 9A; and FIGS. 9B1, 9B2 and 9B3, collectively FIG. 9B, all disclose illustrative operation of the system and methods of this disclosure.

FIGS. 14A, 14B and 14C, collectively FIG. 14, illustrate memory maps of illustrative security coding that may be useable with the parcel theft prevention system of this disclosure.

FIG. 16 illustrates an embodiment of this disclosure employing camera as a sensor of this disclosure.

DETAILED DESCRIPTION

Figure 1:
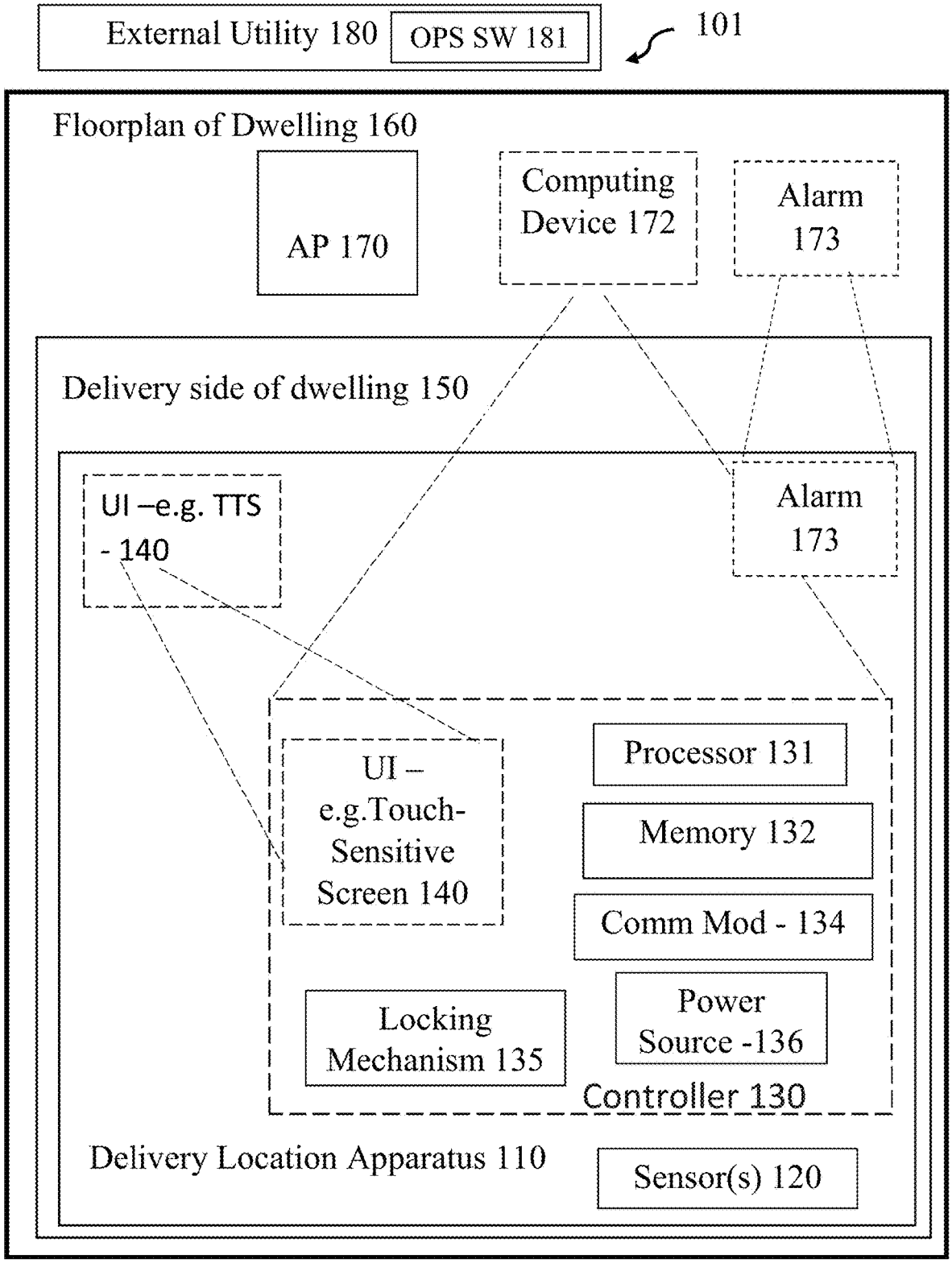
FIG. 1 is an illustrative embodiment of this disclosure.

In the following detailed description, reference is made to the accompanying drawings that form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

Broadly speaking, a porch piracy parcel theft prevention system and method includes a delivery location apparatus configured for attachment to a building to receive a parcel, the delivery location apparatus including a sensor and a parcel locking mechanism. The sensor is configured to detect the presence of a delivered parcel placed into the line of sight of the parcel detecting sensor. The parcel locking mechanism is armed upon entry of a carrier code and disarmed upon entry of a user code. When armed, the parcel locking mechanism is configured to trigger an alarm when the parcel detected locking mechanism detects removal of the parcel from the line of sight of the parcel detecting sensor. When disarmed, the package may be removed from the line of sight of the parcel detecting sensor without tripping the alarm. Among other uses, helps prevent parcel theft from single family dwellings.

FIG. 1 shows an illustrative embodiment porch piracy delivered parcel theft prevention system 101 comprising a delivery location apparatus 110 and a computing system which includes external utility 180 alone or in combination with computing device 172 implementing an order planning system 181 in network communication with the delivery location apparatus 110.

The delivery location apparatus 110 may comprise a sensor 120 and a controller 130 and an alarm 173. The controller 130 may comprise a processor 131, memory 132, a communication module 134, a power source 136, a locking mechanism 135 and a user interface UI 140. The delivery location apparatus 110 may illustratively be adapted to delivery side of a dwelling 150.

In one embodiment, computing device 172 may illustratively be located on floorplan of dwelling 160 separate from the delivery location apparatus 110. In another embodiment explained hereafter, the computing device 172, wherever located, may provide one or more functionality of the delivery location apparatus 110. This is depicted in FIG. 1 with the phantom box around the processor 131, the memory 132, the communication module 134, the power source 136, the locking mechanism 135 and the user interface UI 140 to illustrate that these components may be provided by computing device 172. In this embodiment, the sensor 120 may be wired to the computing device 172; or if a wireless sensor, wireless connected to the computing device 172.

Illustratively, the computing device 172 may be located on the floorplan of dwelling 160. Alternatively, computing device may be located outside of dwelling 160. For example, a computing device may be attached to an outside surface of dwelling (not shown) or reside outside of dwelling, for example, in a housing that is protected from the weather and outdoor elements (not shown) or in an adjacent or other building. By computing device is meant servers, intermediary servers, personal computers, cellular phones, smart phones, wireless computers, wireless lap-top computers, mobile devices such as tablet computers, pad computers, personal digital assistant, wireless sensors or networks of sensors, such as mesh network sensors, and so on may be in electrical communication with to provide functionality to the porch piracy delivered parcel theft prevention system.

In some embodiments external utility 180 may communicate directly with delivery location apparatus through communication module 134 of controller 130 of delivery location apparatus 110. If the controller 130 of delivery location apparatus 110 resides on computing device 172, the communication by the external utility 180 to the computing device 172 may be the communication with the delivery location apparatus 110 in this example.

As used herein, a server may be any computer configured to serve the requests of client programs running on the same or other computers on a network. The computer of the external utility may be a host computer configured to serve the requests of one or more client programs residing in the safety disarm module. Alternatively, the computer of the external utility may serve a client residing on the external utility or on some other computer to which the external utility may be connected. Depending on the computing service that the server is configured to offer, the server may include one or more of a file server for storing and making files accessible for reading and writing to the client, a print server that manages one or more printers, a network server that manages network traffic, a mail server that manages mail on a network, a database server that allows clients to interact with a database, a firearm server for managing firearm records, and so on. The server may also be in communication with one or more other servers that may include one or more of the foregoing or other servers. The foregoing and servers may provide a service to the users of the piracy theft prevention system of this disclosure. For instance, the print server may enable a user to print an image of information on why the locking mechanism 135 was not armed, or information on the use of the piracy theft prevention system such as day and time of use, time of delivery of a parcel, number of deliveries, time of disarming of the locking mechanism 135, system status and upgrades, and so on. Sensors associated with the piracy protection system of this disclosure may track deliveries for printing by the print server, reporting by the utility 180, and so on for investigative, historical, archival, or other purposes.

In some embodiments, the UI 140 may be located on the delivery side of dwelling 150. UI 140 is also shown in phantom lines to illustrate that UI 140 may be located on the computing device instead of on the delivery side of dwelling 150. Alternatively, both the delivery side of dwelling 150 and the computing device 172 may provide UI 140 for use with this disclosure.

In another embodiment, all of the components shown in controller 130 reside in the delivery location apparatus 110, separate and apart from external utility 180 and computing device 172.

As explained herein, delivery location apparatus includes alarm 173 which is shown in phantom lines. Alarm 173 is shown in phantom lines to illustrate that alarm 173 may be located on the delivery side of dwelling 150. Alternatively, alarm 173 may be located on the floorplan of dwelling 160. In one example, the alarm 173 may be located on a wall of dwelling 160. In another embodiment, the porch piracy delivered parcel theft prevention system of this disclosure may be integrated into a security system that the homeowner may employ for the house. Such home security systems are networks of integrated electronic devices working together with a central control panel to protect against burglars and other potential home intruders and typically include an alarm. In this embodiment, the homeowner may use the alarm of his or her home security system for the alarm in porch piracy delivered parcel theft prevention system of this disclosure. In this example, the porch piracy delivered parcel theft prevention system may trigger the alarm of the home security system in this disclosure. In another embodiment, an alarm of the porch piracy delivered parcel theft prevention system of this disclosure is configured to reside on a side of dwelling 150 that is other than the delivery side of dwelling 150. In another embodiment, an alarm is located outside the floorplan of dwelling 160 and not on the dwelling 150. For example, an alarm may reside outside of dwelling, for example, in a housing that is protected from the weather and outdoor elements (not shown) or in an adjacent or other building. Any of the above or other combinations of alarm configurations may be used with this disclosure. In addition, any number of alarms may be used with this disclosure. For example, in another embodiment, alarms on both delivery side of dwelling 150 and floorplan of dwelling 160 may be used with the porch piracy delivered parcel theft prevention system of this disclosure.

FIG. 1 depicts delivery location apparatus 110 comprising the indicated functional components of sensor 120 and controller 130 and alarm 173. These functional components may be integrated into an integrated delivery location apparatus 110 or be distributed in a constellation that together form the deliver location apparatus 110 of this disclosure. In one constellation, the UI 140 may be separate and apart from the other components of the delivery location apparatus 110, the other components being bundled together into an integrated unit. In another constellation, the UI 140 and alarm 173 may be individual units separate and apart from the other components of the delivery location apparatus 110, the other components being. Other arrangements of the individual units are within this disclosure.

As explained, controller 130 may comprise the processor 131, the memory 132, the communication module 134, the power source 136, the locking mechanism 135 and the user interface UI 140.

The controller 130 is configured to control the parcel detected locking mechanism 135 and includes an input device, such as UI 140. The controller 130 may be hardware and software configured to process instructions. The processor 131 may be implemented in any number of ways. Such ways include, by way of example and not of limitation, digital and/or analog processors such as microprocessors and digital-signal processors (DSPs); controllers such as microcontrollers; software running in a machine; programmable circuits such as Field Programmable Gate Arrays (FPGAs), Field-Programmable Analog Arrays (FPAAs), Programmable Logic Devices (PLDs), Application Specific Integrated Circuits (ASICs), any combination of one or more of these, and so on.

The memory 132 of controller 130 may be any physical device capable of storing information temporarily or permanently. Memory may be implemented in any number of ways. Such ways include, by way of example and not of limitation, nonvolatile memories (NVM), read-only memories (ROM), random access memories (RAM), any combination of these, etc. Memory 1130 may include programs containing instructions for execution by processor 131 or a processor external to the controller 130. The instructions perform the functions described in this disclosure including performing protocols, decision making analytics, and so on. In addition, memory 132 may store rules, configurations, data, etc.

Communication module 134 may comprise a wireless module and/or a module data connect port. The wireless module may illustratively be a Wi-Fi module. Alternatively, the wireless module 491 may be a blue tooth module, a CDMA module, or any other communication module that enables a wireless communication link for the bidirectional flow of data between devices wirelessly. The module data connect port may be a hardware based data connector configured to connect with the computing device 172 via hardware. Illustratively, the module data connect port may be an RS232 plug connector configured for connection to a socket connector (not shown) of the computing device 172 in a wired connection. While the foregoing disclosure of the module data connect port is illustrative based on the RS232 standard, it will be appreciated that module data connect port may include a USB or other wire connector. In addition, while the module data connect is disclosed as hardware based, it will be appreciated that the hardware may be configurable by software in which case the hardware and software together may together form the module data connect port of this disclosure. Other communication modules are well known in the art.

Delivery location apparatus 110 may also include a power source 136. Power source 136 may be provided by AC power available at the dwelling. Alternatively, power source 136 may be provided by a battery.

User interface UI 140 may be configured in any number of ways. For example, UI 140 may include a screen to display data and information. Displayed data may be data like the numbers of a security code explained in detail later in this disclosure that may be entered into the delivery allocation apparatus as explained below. Displayed information may include menus to direct a user on what to do, to provide feedback to the user on the porch piracy delivered parcel theft prevention system 101, and so on. UI 140 may also include a speaker, to issue voice prompts, etc. UI 140 may additionally include various controls, such as pushbuttons, keyboards, and so on. In addition, delivery location apparatus 110 may be controlled by controller 130, or directly by user via UI 140, and so on.

Illustratively, UI 140 is a touch-sensitive screen to allow an operator to interface with the porch piracy delivered parcel theft prevention system. The touch-sensitive screen may be a computer display screen that serves as the input device. Illustratively, the touch-screen may be integrated with the delivery location apparatus 110 to allow an operator of the delivery location apparatus 110 to provide input commands to the delivery location apparatus 110 and to scroll, navigate, and zoom image, system status, and other data rendered on the touch-sensitive screen. Alternatively, any enable/disable control interface may be used in place of the touch-screen.

The screens may be sensitive to pressure. A user may interact with the wireless device by touching pictures or words on the screen. The touch-sensitive screen may be configured to visually display information and to received input, including touches and gestures entered by an operator. Alternatively, the touch-sensitive screen may be provided by the display of a wireless mobile device. Illustrative examples of wireless mobile devices include tablet computers, smartphones, and certain portable media players that execute general-purpose operating systems.

As described above, the touch-sensitive screen may allow the image, system status, or other data to be displayed on UI 140 on the touch-sensitive screen, and may receive control input indicating desired motion and/or other function control via the UI. The desired motion may be scrolling, navigating, and zooming image, system, and other data rendered on the touch-sensitive screen. This control input may be passed to the network for transmission back to the external utility 180 (FIG. 1) (which may be a server) where permitted. The network may be a public or private network, or combination of both.

The touch-sensitive screen may also enable an operator of the delivery location apparatus 110 to pass data to the network through a wireless network interface, such as access point AP 170 for transmission back to an external utility (e.g., server 180) over a wireless network, when permitted. The touch-sensitive screen may also render on the display of the touch-sensitive screen data received over the wireless network from a cloud service or other external utilities over the network. For instance, data streamed into the delivery location apparatus 110 for rendering on the touch-sensitive screen (or for broadcast audibly) may include data on why one or more features of a delivery location apparatus 110 remains disabled, data requiring the operator to perform certain steps before enabling the wireless device, data resulting from a check done by a cloud server, and so on.

In one aspect controller 130 communicates with external utility 180 through access point AP 170. An access point is a networking hardware device that allows other devices to connect to a wired network. In one example, communication module and AP 170 are configured for Wi-Fi communication capability in order to connect controller 130 to AP 170 for communication with external utility 180. Alternatively, controller 130 may communicate with external utility 180 directly or through computing device 172. Computing device may communicate with the external utility directly or through AP 170. Any wireless or wired communication between the controller 130 and external utility 180 may be employed. Wireless communication may include wireless connections based upon Wi-Fi, cellular, satellite, or other protocols or technologies.

Both the parcel detected locking mechanism 135 and the parcel detecting sensor 120 will now be explained through the following illustrative example.

In this illustrative embodiment, the delivery location apparatus 110 includes the parcel detecting sensor 120, the parcel detected locking mechanism 135, the controller 130 and a mounting mechanism (not shown).

As previously explained, the delivery location apparatus 110 is associated with and configured to be adapted to a building to receive a parcel.

The parcel detecting sensor 120 may detect the presence or absence of objects within a FOV (depicted in FIG. 9B) of the parcel detecting sensor 120. The parcel detecting sensor 120 may comprise an image capture sensor, another sensor, or a combination of both. The image capture sensor may be hardware and software configured to capture an image. Image capture sensors typically include one or more light sensors. A light source may also be included to emit light to be reflected off an object. The light sensors capture and translate the reflected light into electrical signals. The image captured may be a photo image. For example, the light sensors may be a high-pixel resolution CCD (charge coupled device) chip and it and associated hardware may be used for generating digital images. The software for processing the captured images may reside in the memory 1130 or a section of memory. Alternatively, the image capture sensors may be provided with a processor and a memory for storing and executing this image processing software.

Parcel detecting sensor 1200 may include other sensors configured to detect the presence or absence of objects within their FOV. In one example, an infrared detector may be used. The infrared detector may be active or passive. The active infrared sensor operates by transmitting energy from either a light emitting diode (LED) or a laser diode. An LED may be used for non-imaging active IR detector, and a laser diode may be used for an imaging active IR detector. In both types of detectors the LED or laser diode illuminates the target, and the reflected energy is focused onto a detector consisting of a pixel or pixel array. The measured data may then be processed using various signal-processing algorithms to extract the desired information. The active IR detector may provide parcel presence data. The laser diode may be used for parcel classification since it may provide parcel profile and shape data.

In another example, an ultrasonic detector may be used. The detector transmits ultrasonic energy and measures the energy reflected by the target. These measurements may be processed to obtain measurements of parcel presence.

In another example, a microwave/millimeter wave radar detector may be used. The detector measures the energy reflected from parcels placed within the field of view. By processing the information received in the reflected energy, the detectors may measure presence of a parcel.

In another example, a passive acoustic detector array may be used. An array of microphones may be used to determine the presence of a parcel. The signals from the microphones in the array may be processed and correlated to obtain information about the presence of a parcel.

Figure 3:
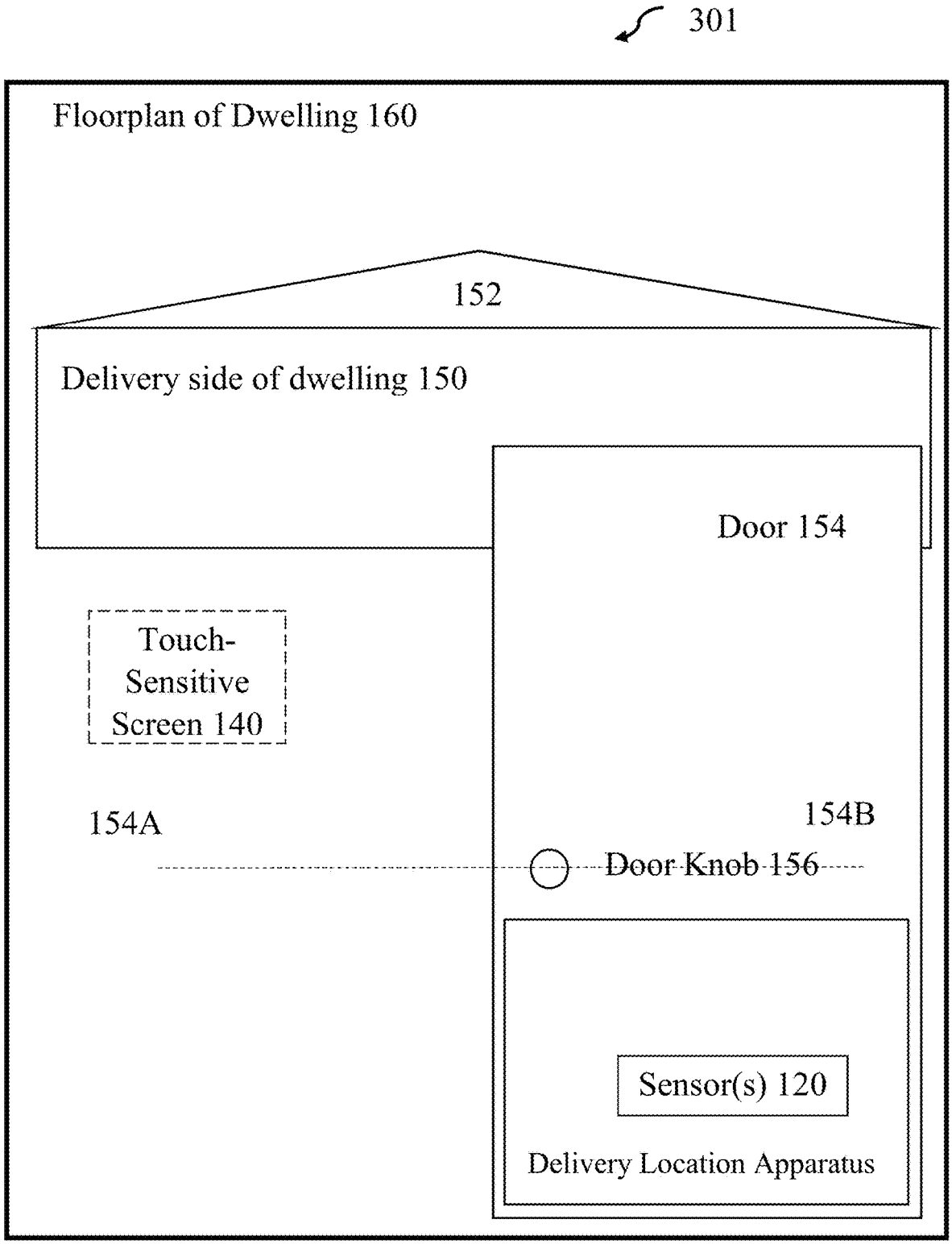

In another example, a piezoelectric detector may be used. In one embodiment, the piezoelectric detector may be embedded flush with the ground over an area 921 on which the parcel may be placed as depicted in FIG. 9B3. When a parcel is placed against it to compress the piezoelectric material, a voltage is produced.

In another embodiment, the area 921 may form a parcel placement pad as depicted in FIG. 9B3. One or more or an array of piezoelectric detectors may cover an area where the parcel may be placed to form parcel placement pad 921 in FIG. 9B3 to allow for detection of one or more than one parcel.

One parcel 909*a* may be placed atop parcel placement pad 909*a*. Alternatively, more than one parcel may be placed one on top of the other or alongside each other with the piezoelectric detector configured to produce different voltage levels by for example weight so that a first parcel 909*a*, 909*b* in FIG. 9B3 may cause the detector to generate a first voltage 924, 925 and the placement of a second parcel 923*a* atop the first parcel 923*a* may cause the detector to generate a second voltage 925. The generation of different voltage levels may be recognizable by the system as there having been put two parcels on the piezoelectric detector in this example.

Figure 2A:
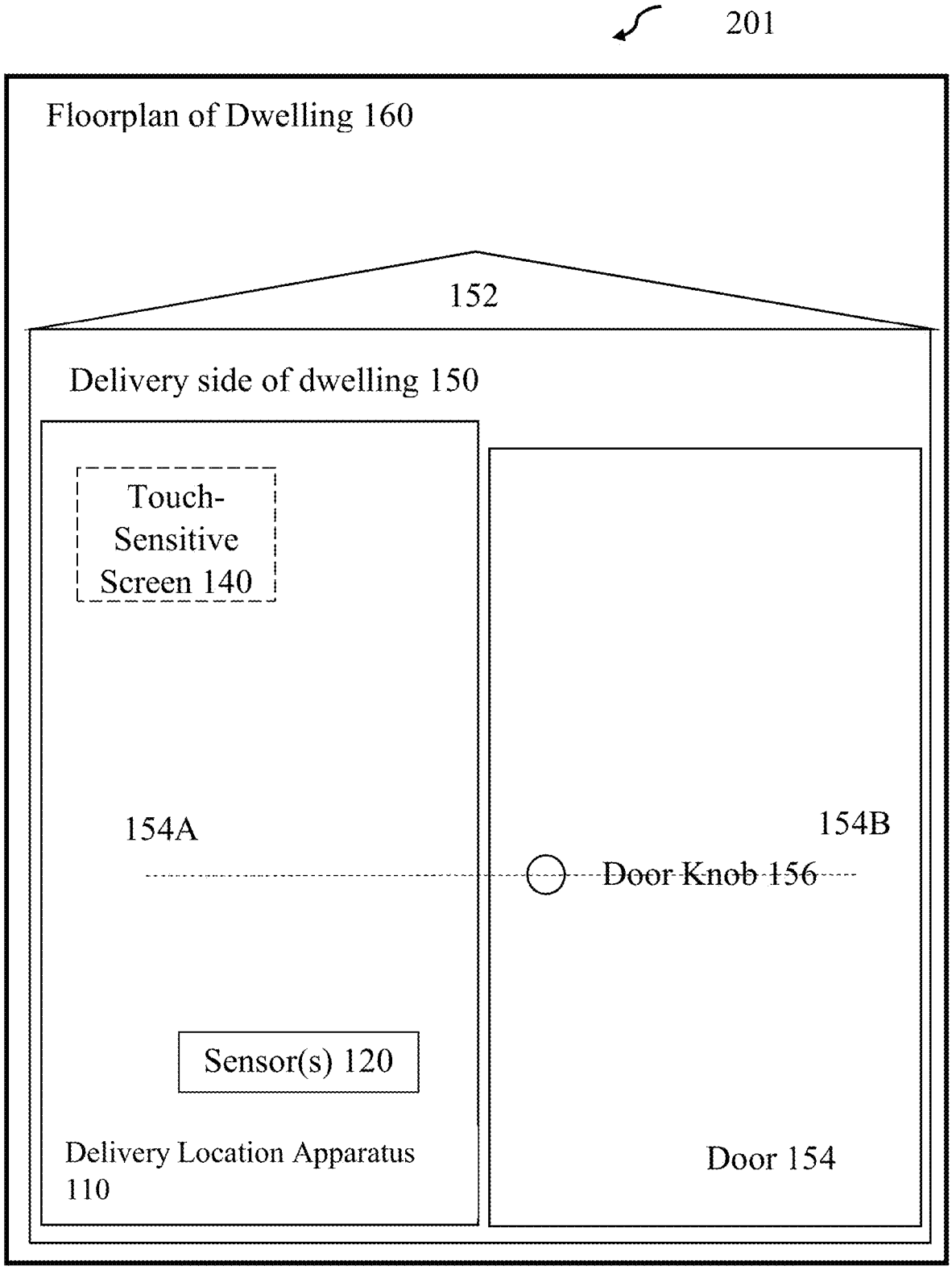
FIGS. 2A, 2B and 2C and FIGS. 3, 4, 5 and 6 illustrate different embodiments of the delivery side of a dwelling according to this disclosure.

In another example, a photoelectric device may be used. The photoelectric device may include a light source and a detector. FIG. 9B2 shows a light source 915 and a detector 918 in the same place. When placed together, the detector is activated when light from the light source is reflected from a parcel 909 and back onto the detector.

In another embodiment, a light source 907 and a detector 905 may be placed across from each other. When placed across from each other, the detector may be activated whenever a parcel 909 obstructs the illumination 906 from the light source 907.

In another embodiment, spread spectrum radar technology may be employed. The radars may permit an automatic vision of the environment in the field of view. In one example, a spread-spectrum wideband radar may be used. In one example, a radar detector with a range of about 20 feet may be used.

In another embodiment, inductive loop detectors may be used. A loop detector consists of one or more loops of wire embedded in the ground and connected to the controller 130. When a parcel is placed on the loop, the inductance of the loop may be reduced. This cause a detection to be signaled to the controller.

In another embodiment, acceleration detectors may determine presence of a parcel by acceleration of the parcel in the field of view. In one embodiment, an array of detectors may determine whether a parcel is accelerating across the field of view of the array. A detection may be signaled to the controller.

Other sensors configured for detecting a parcel within the field of view of the sensor may be employed. Without limitation, these sensors may include motion sensor, heat, location accelerometer, a gyroscope, a magnetometer, a proximity sensor, a gravity sensor, a linear accelerometer, and so on. Additional sensors may include light sensor, camera sensors, microphone sensors, touch sensors, pressure sensor, temperature sensor, humidity sensor, and so on.

These and other sensors allow for a variety of configurations to provide a variety of field of view configurations for parcels with the range and other requirements of the system being a design choice.

The parcel detecting sensor 120 is configured to detect a parcel or other attributes like motion, physical attributes, and so on, when the parcel is placed in a line of sight of the parcel detecting sensor 120. The line of sight means that the parcel is within the field of view (FOV) of the parcel detecting sensor 120. The FOV is, within the angle of view of the parcel detecting sensor 120, the horizontal (or vertical or diagonal) length of the image at a given distance from the parcel detecting sensor 120. For an image sensor, the FOV is the FOV of the image sensor. For other sensors that may be used as the parcel detecting sensor 120 according to this disclosure, the FOV is the region, or space, or footprint or like that the parcel detecting sensor 120 may detect attributes of a parcel placed within that region, or space, or footprint, or like. For example, for a motion sensor, the FOV may be the range in which the sensor detects motion of an object.

The FOV of the parcel detecting sensor 120 effectively defines a virtual storage compartment. An item may be shipped to the delivery location apparatus 110 and stored in the virtual storage compartment of this disclosure for retrieval by the customer in accordance with this disclosure.

The parcel detecting sensor 120 may be used to detect the presence or absence of objects within the virtual storage compartment. It may also detect other aspects of objects within the virtual storage compartment such as the motion of placing an object in the virtual storage compartment. Data generated by the parcel detecting sensor 120 may be used by the porch piracy delivered parcel theft prevention system of this disclosure. For example, the system may alert a user that a parcel is available for retrieval. It may also send a user notification if a delivered parcel is being pirated.

Figure 4:
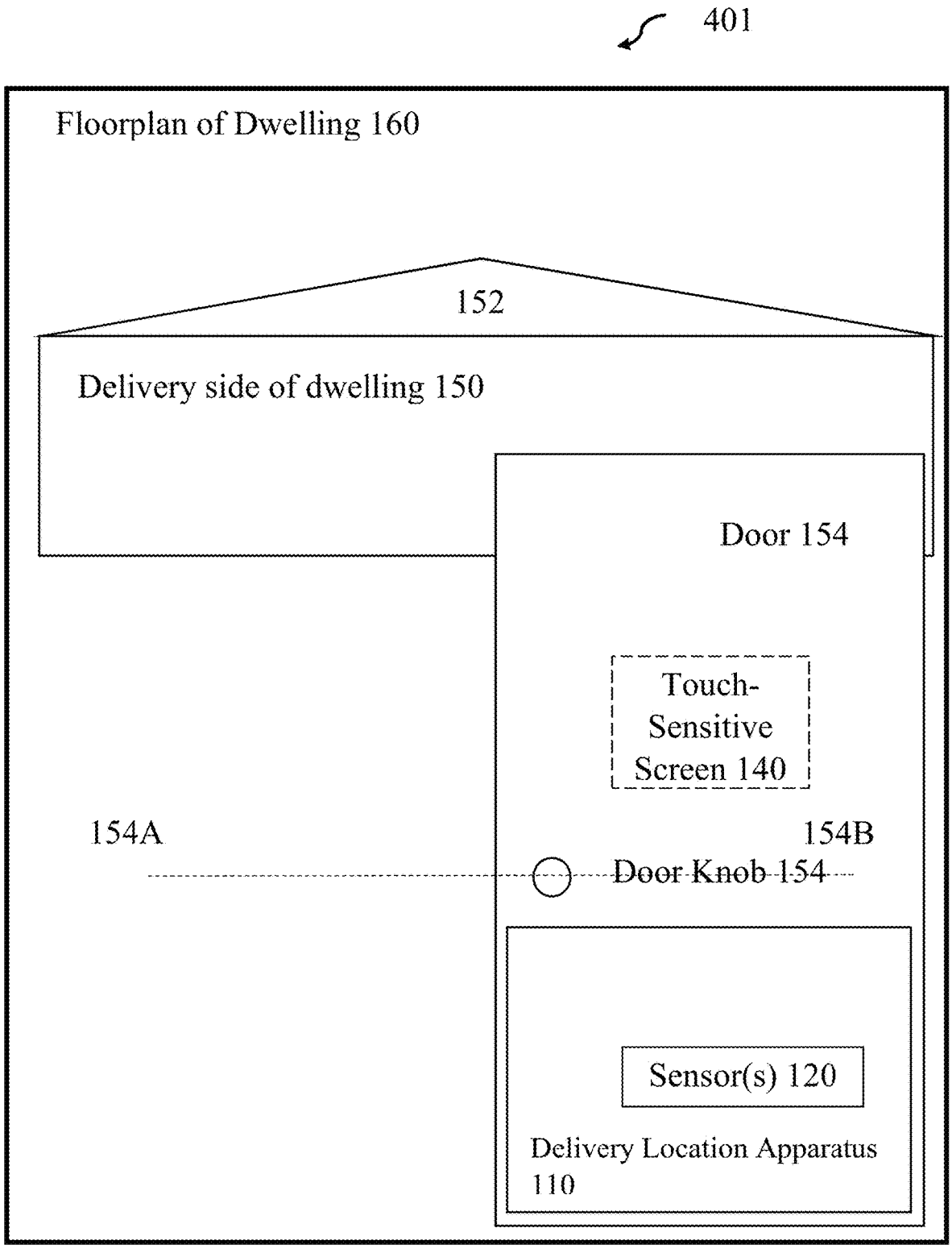
Figure 5:
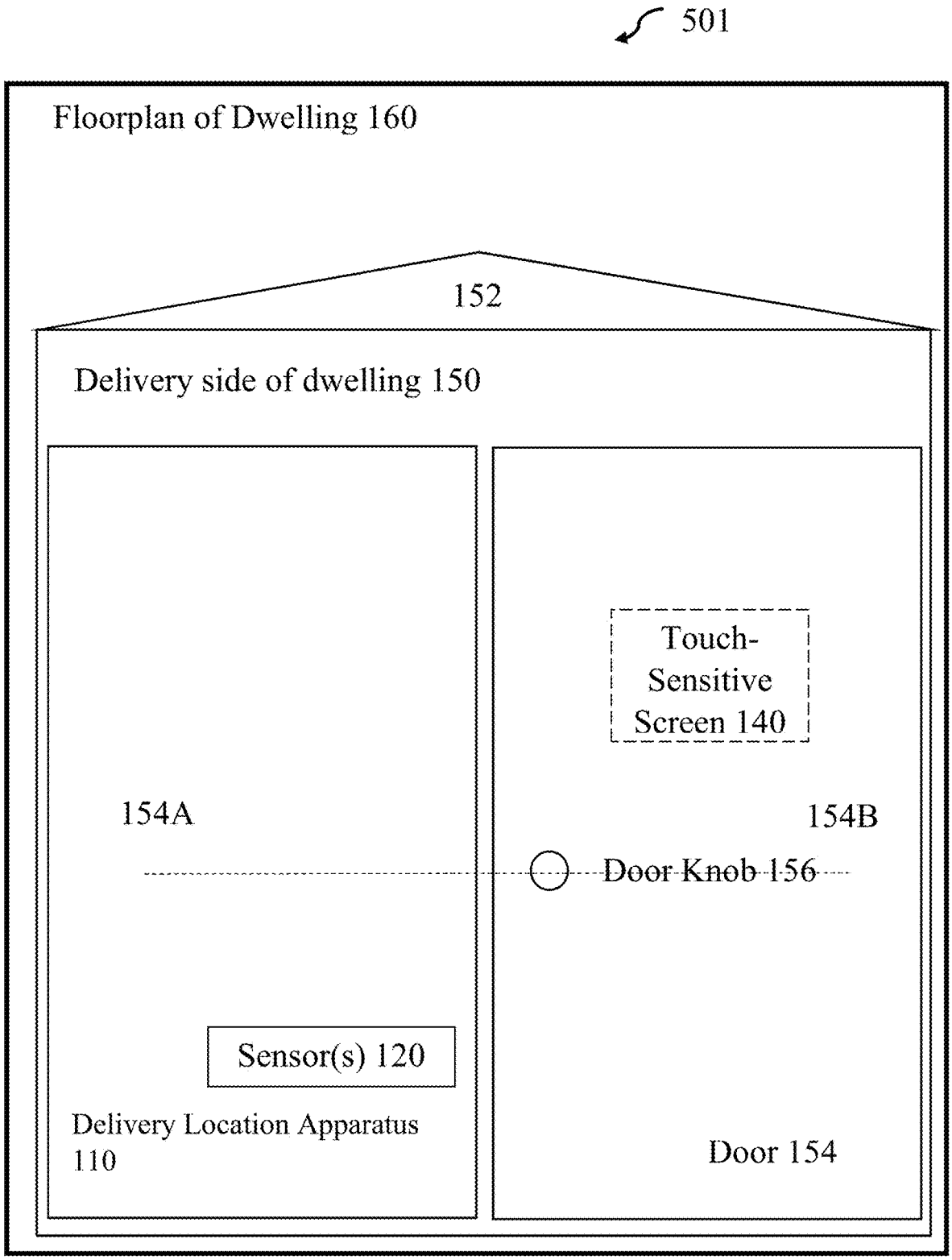
Figure 6:
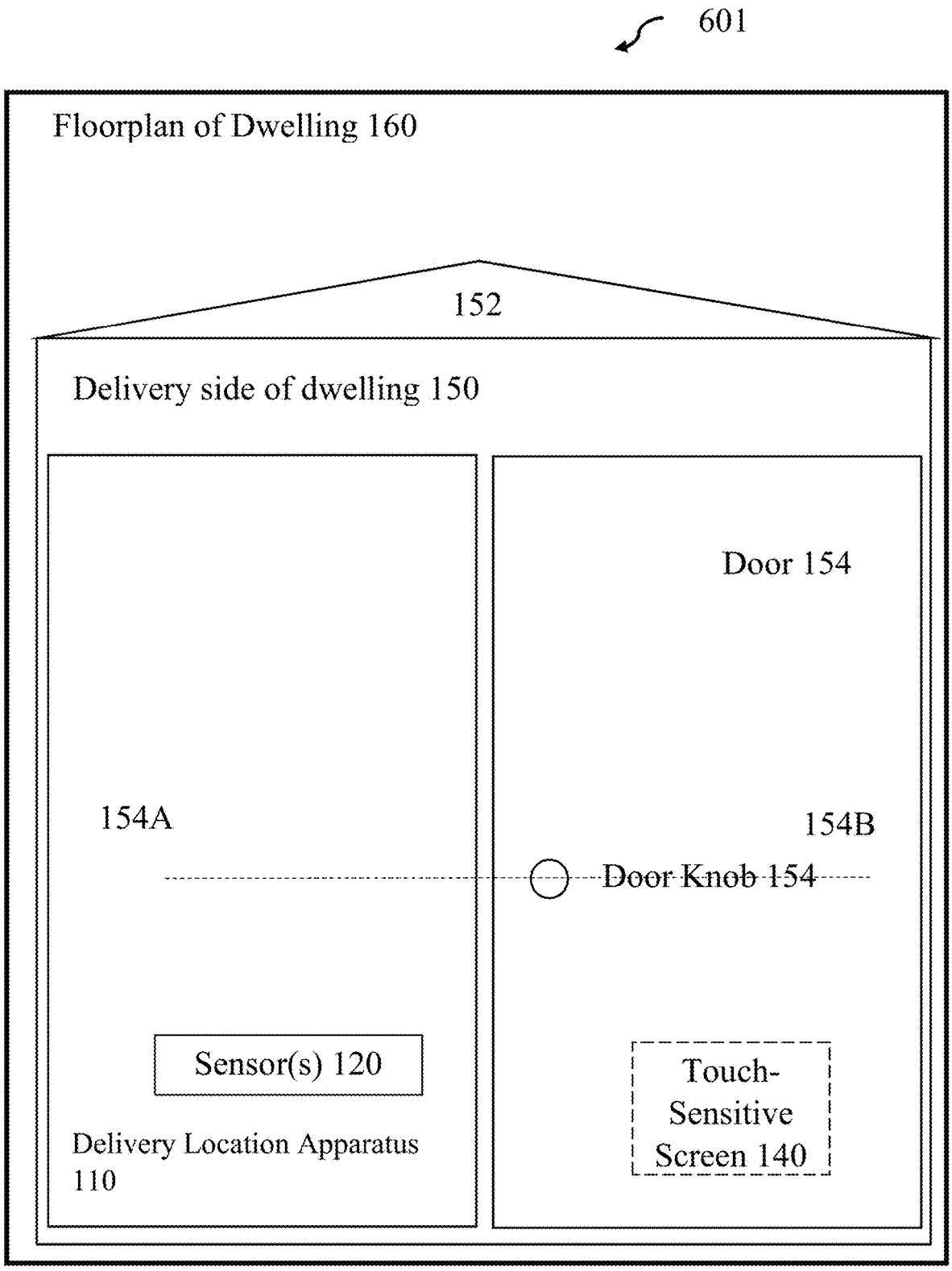

The parcel detecting sensor 120 may be adapted to the delivery side of dwelling 150 as illustrated in FIGS. 2, 5, 6. Alternatively, the parcel detecting sensor 120 may be adapted to a door 154 as illustrated in FIGS. 3 and 4. In another illustrative embodiment a plurality of sensors may be employed and adapted to both the delivery side of dwelling 150 and door in combination. The delivery side of dwelling may be a front, side, or back side of dwelling. In illustrative embodiments, the dwelling may employ a parcel detecting sensor 120 on one or more delivery sides of a dwelling or one or more doors or any combination. In illustrative embodiments employing a parcel detecting sensor 120 on one or more delivery sides of a dwelling, the parcel detecting sensor 120 may be adapted to the delivery side of dwelling 150 as illustrated in FIGS. 2, 5, 6; to a door 154 as illustrated in FIGS. 3 and 4; or combination thereof.

Illustrative embodiments depicted in FIGS. 2A, 2B, 3-6 depict a delivery side of dwelling 150 as a side with a door 154. In FIG. 2C, the delivery side of dwelling is depicted without a door. As used herein, the delivery side of a dwelling is the side of a dwelling wherein parcels are delivered.

In FIGS. 2A, 2B, 3-6 illustrating a delivery side of dwelling 150 as a side with a door 154, illustrative embodiments depicted in FIGS. 2A, 3 through 6, illustrate that the parcel detecting sensor 120 may be located below the axis 154A,B of door knob 156.

The parcel detecting sensor may be illustratively adapted to the dwelling above the ground at the delivery location apparatus 110. The ground at the delivery location apparatus 110 is any flat surface in front of the dwelling or a door on which a parcel may be left. The parcel detecting apparatus may be adapted to the dwelling at a height sufficient for parcels that may be delivered to the dwelling to be within the field of view of the sensor. The location of the sensor of the parcel detecting apparatus is a matter of design choice. Illustratively, the sensor of the parcel detecting sensor may illustratively be located at 1 inch, 2 inches, 3 inches, 4 inches, 5, inches, 6 inches, 7 inches, 8 inches, 9 inches, 10 inches, 11 inches, 12 inches above the ground or at heights therebetween. Alternatively, the sensor may be illustratively adapted to the dwelling at 24 inches above the ground or at heights therebetween. In another embodiment, the sensor may be illustratively adapted to the dwelling at 36 inches above the ground or at heights therebetween. In another embodiment, the sensor may be illustratively adapted to the dwelling below the axis 154A,B of door knob 156.

Figure 2B:
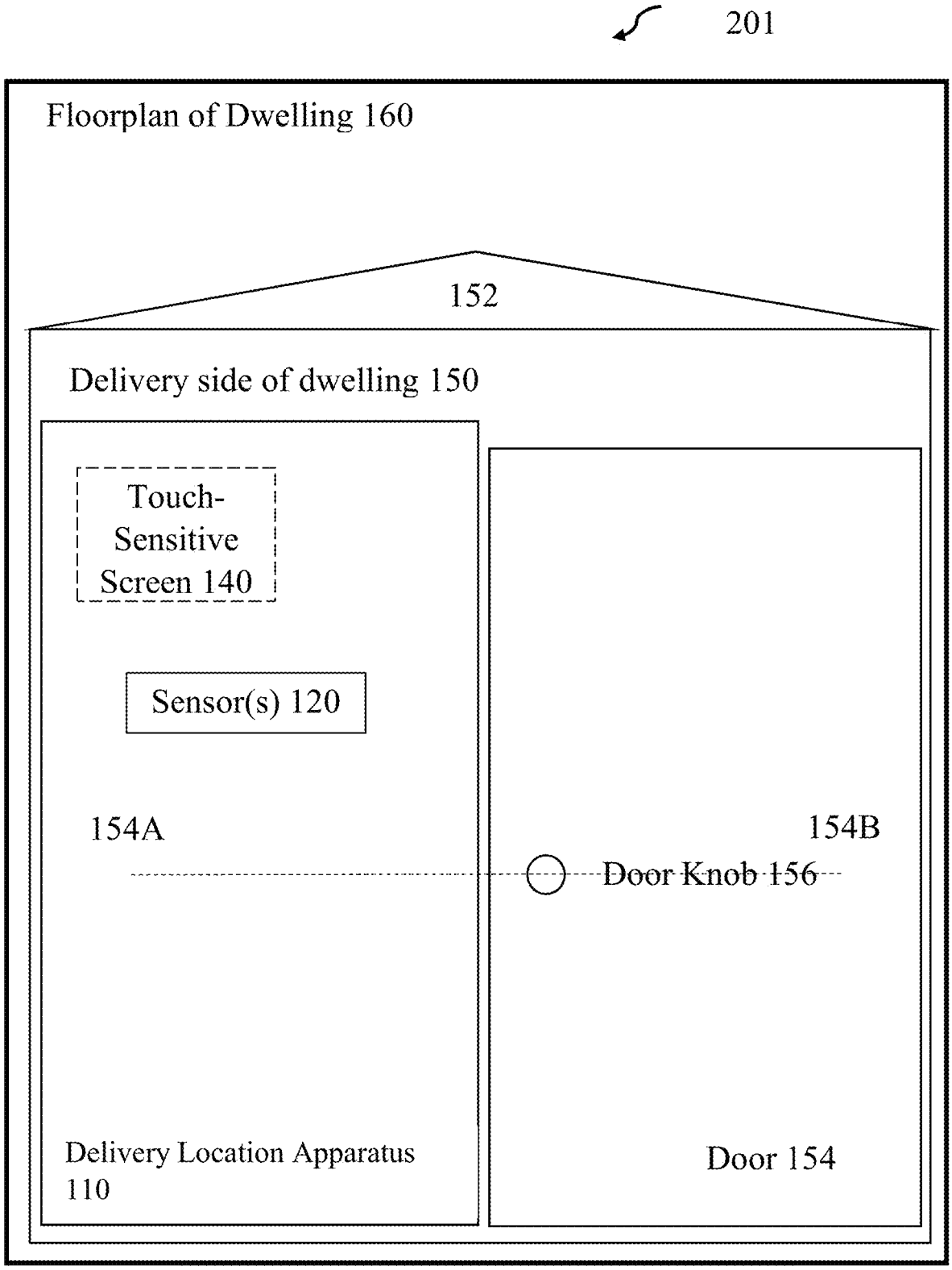
Figure 2C:
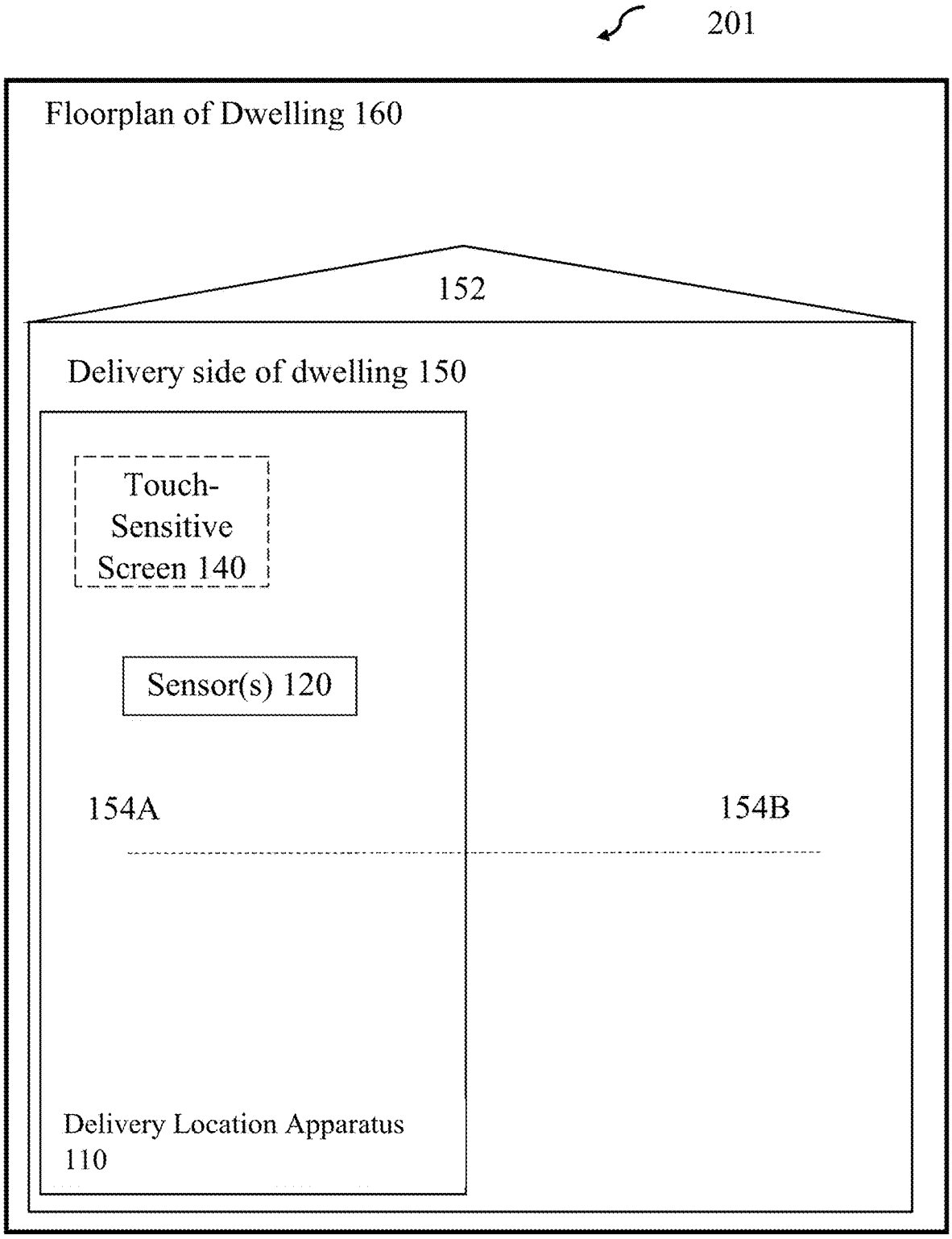

In illustrative embodiment depicted in FIG. 2B, the parcel detecting sensor 120 is located above the axis 154A,B of door knob 156. In this embodiment, a parcel holder 121 as depicted in FIG. 8B2 may be adapted to the dwelling 150 to provide a surface on which the parcel may be supportively placed in the field of view of the parcel detecting sensor 120 as illustrated in FIG. 8B. Illustratively, the parcel holder 121 may be a ledge made from wood that may be secured to the dwelling with screws or in other ways known in the art so as to support the load of parcels that may be placed thereon.

The parcel may be placed below the axis 154A,B of door knob 156 such that the parcel appears in the field of view of the parcel detecting sensor 120 as illustrated in FIGS. 8A and 9 with FOV in FIG. 9B showing the field of view. The FOV is, within the angle of view of the parcel detecting sensor 120, the horizontal (or vertical or diagonal) length of the image at a given distance from the parcel detecting sensor 120.

The parcel may be placed anywhere in the FOV of the parcel detecting sensor. FIG. 9B illustrates the parcel set back from the parcel detecting sensor a predetermined distance. This allows for a longer horizontal (or vertical or diagonal) length of the image from the parcel detecting sensor 120 such that data on more or all of the parcel of one or more parcels delivered (e.g., stacked one on top of each other or side by side or in front of or behind or combinations thereof) may be captured. In alternative embodiment, the one or more parcels may be set up against the parcel detecting sensor. Placement of the parcel within the FOV of the parcel detecting sensor enables the computing system of this disclosure to register the delivered parcel and its removal as explained in this disclosure.

Illustratively, the placement of the parcel is 12 inches or less from the parcel detecting sensor 120. Alternatively, the placement of the parcel is 6 inches or less from the parcel detecting sensor 120. In another embodiment, the placement of the parcel is 3 inches or less from the parcel detecting sensor 120. In another embodiment, the parcel is placed near the parcel detecting sensor 120. In another embodiment, the parcel is placed in front of the parcel detecting sensor 120. In another embodiment, the parcel is placed against the parcel detecting sensor 120. Alternatively, the parcel may be placed at more than 12 inches from the parcel detecting sensor 120. The location from the detecting sensor 120 where the parcel may be placed according to this disclosure is a matter of design choice.

The parcel detected locking mechanism 135 is configured to trigger an alarm when, in a locked position, the parcel detected locking mechanism detects removal of the parcel placed in the line of sight of the parcel detecting sensor. FIG. 14 depicts illustrative security-loaded pins or codes for parcel detected locking mechanism 135 according to this disclosure. The locking mechanism 135 may be implemented in hardware, software, or a combination thereof. In the context of software, the implementation represents computer-executable instructions stored on one or more computer readable media that, when executed by one or more processors, perform the recited operations. Generally, computer-executable instructions include routines, programs, objects, components, data structures, and the like that perform particular functions or implement particular abstract data types.

Turning more specifically to the security-loaded pins or codes, FIG. 14 depicts illustrative security-loaded pins or codes in three columns of a memory map for operating the parcel detected locking mechanism 135 by individual, issued code, and the state of the alarm, respectively, in one illustrative embodiment. In FIG. 14A embodiment, delivery carrier 1402 is issued a code 1412 for delivery which sets alarm 1422. Homeowner 1403 is issued a code 1413 which disables 1423 alarm. These conditions for enabling and disabling the parcel detected locking mechanism 135 are employed by the computer-executable instructions stored on one or more computer readable media that, when executed by one or more processors, perform the recited operations illustrated in FIG. 15A to lock or unlock the parcel detected locking mechanism 135. Generally, computer-executable instructions include routines, programs, objects, components, data structures, and the like that perform particular functions or implement particular abstract data types.

As used herein, a homeowner may be the owner of the dwelling or anyone authorized to receive deliveries at the dwelling. While the illustrative example depicts a homeowner, this disclosure applies to anyone authorized to receive deliveries at a building. The building may be a house, apartment, dwelling, residential building, commercial building, or any other building where deliveries may be made.

FIG. 14B illustrates an alternative illustrative security-loaded pins or codes in three columns of a memory map for operating the parcel detected locking mechanism 135. The alarm activated schema for parcel detected locking mechanism 135 with illustrative security-loaded pins or codes depicted in FIG. 14B involve setting of two conditions. Seller 1401 is issued code 1411 at time of sale which is used to set condition 1 for alarm 1421. Delivery carrier 1402 is issued code 1412 to set condition 2 for the alarm 1422. In one embodiment, on entry of issued code 1412 by delivery carrier 1402 at the delivery location apparatus 110, the system prompts the seller through the computing system implementing an order planning system of this disclosure to release the seller code 1411 to the delivery location apparatus 110. The seller code may be sent by the seller to the delivery location apparatus 110 directly, such as wirelessly communicated to the delivery location apparatus 110. Alternatively, the seller code may be sent to the delivery location apparatus 110 for retrieval by the delivery carrier 1402 for entry by the delivery carrier 1402 into a touch sensitive screen 140 on the delivery side of dwelling. The seller code may be communicated to the delivery location apparatus 110 in other ways. Homeowner 1403 is issued a code 1413 by the computing system implementing an order planning system which may be used by the homeowner to disable 1423 alarm.

Figure 15A:
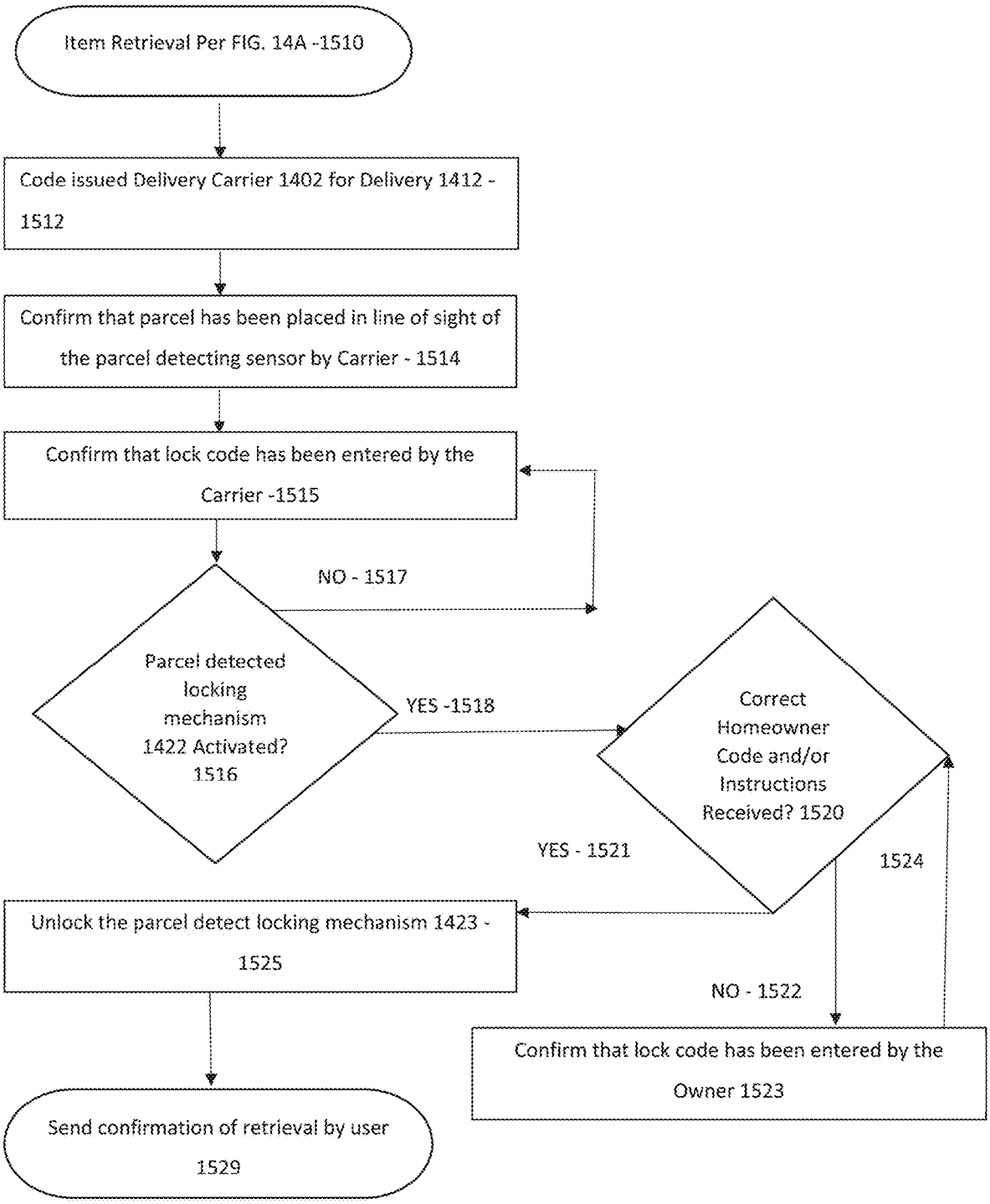
FIGS. 15A, 15B and 15C illustrate methods employing the security coding disclosed in connection with FIG. 14.
Figure 15B:
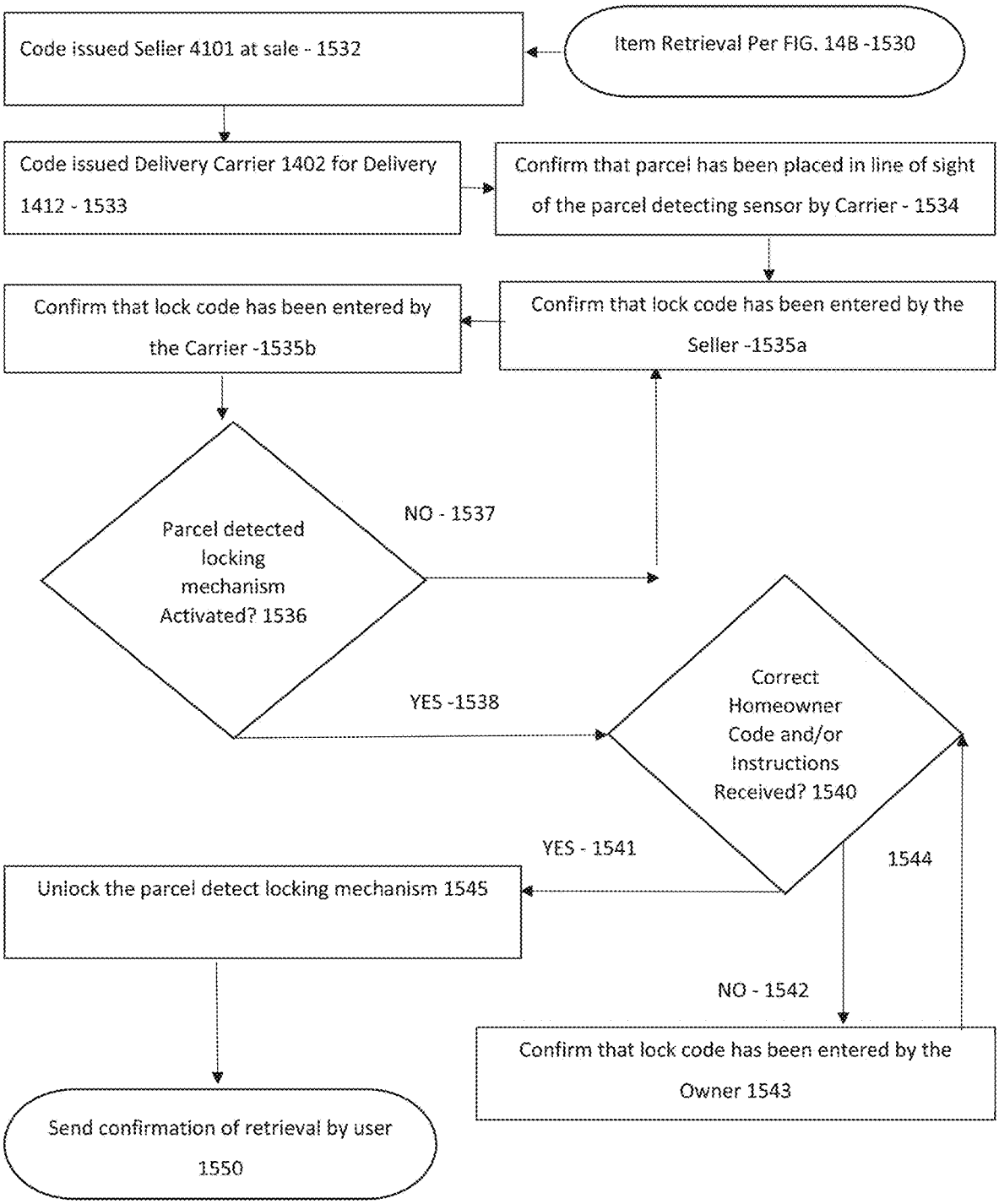

These conditions for enabling and disabling the parcel detected locking mechanism 135 are employed by the computer-executable instructions stored on one or more computer readable media that, when executed by one or more processors, perform the recited operations illustrated in FIG. 15B to lock or unlock the parcel detected locking mechanism 135. Generally, computer-executable instructions include routines, programs, objects, components, data structures, and the like that perform particular functions or implement particular abstract data types.

FIG. 14C illustrates an alternative illustrative security-loaded pins or codes in three columns of a memory map for operating the parcel detected locking mechanism 135. The alarm activated schema for parcel detected locking mechanism 135 with illustrative security-loaded pins or codes depicted in FIG. 14C involve setting of two conditions. The schema is similar to that schema explained in FIG. 14B save for code 1413 of the homeowner which in FIG. 14C is created by the homeowner. These conditions for enabling and disabling the parcel detected locking mechanism 135 are employed by the computer-executable instructions stored on one or more computer readable media that, when executed by one or more processors, perform the recited operations illustrated in FIG. 15C to lock or unlock the parcel detected locking mechanism 135. Generally, computer-executable instructions include routines, programs, objects, components, data structures, and the like that perform particular functions or implement particular abstract data types.

An advantage of the schema of FIG. 14C is that the homeowner may create his or her own passcodes for disabling an alarm which may be easier to remember. In addition, in another embodiment the porch piracy delivered parcel theft prevention system of this disclosure may be integrated into a security system that the homeowner may employ for the house. Such home security systems are networks of integrated electronic devices working together with a central control panel to protect against burglars and other potential home intruders. In the example of FIG. 14C, the homeowner may use the passcode for his or her home security system for the passcode for disarming the alarm of this disclosure, thereby enabling one passcode to serve both home security arm/disarm and disable of alarm in porch piracy delivered parcel theft prevention system of this disclosure.

The mounting mechanism (not shown) is configured to attach the delivery location apparatus to an outside surface of the building to enable a user to retrieve an item from the line of sight of the parcel detecting sensor while the user is at the delivery location. For example, a delivery location apparatus may be contained in a housing provided with one or more bore flanges for receiving screws therethrough for securing the housing to the building. Any mechanism for securely mounting the delivery location apparatus to a building may be used for the mounting mechanism of this disclosure.

As previously explained, the computing system includes external utility 180 alone or in combination with computing device 172 implementing an order planning system 181 in network communication with the delivery location apparatus 110. The computing system implementing the order planning system 180 may thus include one or more processors and a memory coupled to the one or more processors.

Figure 7:
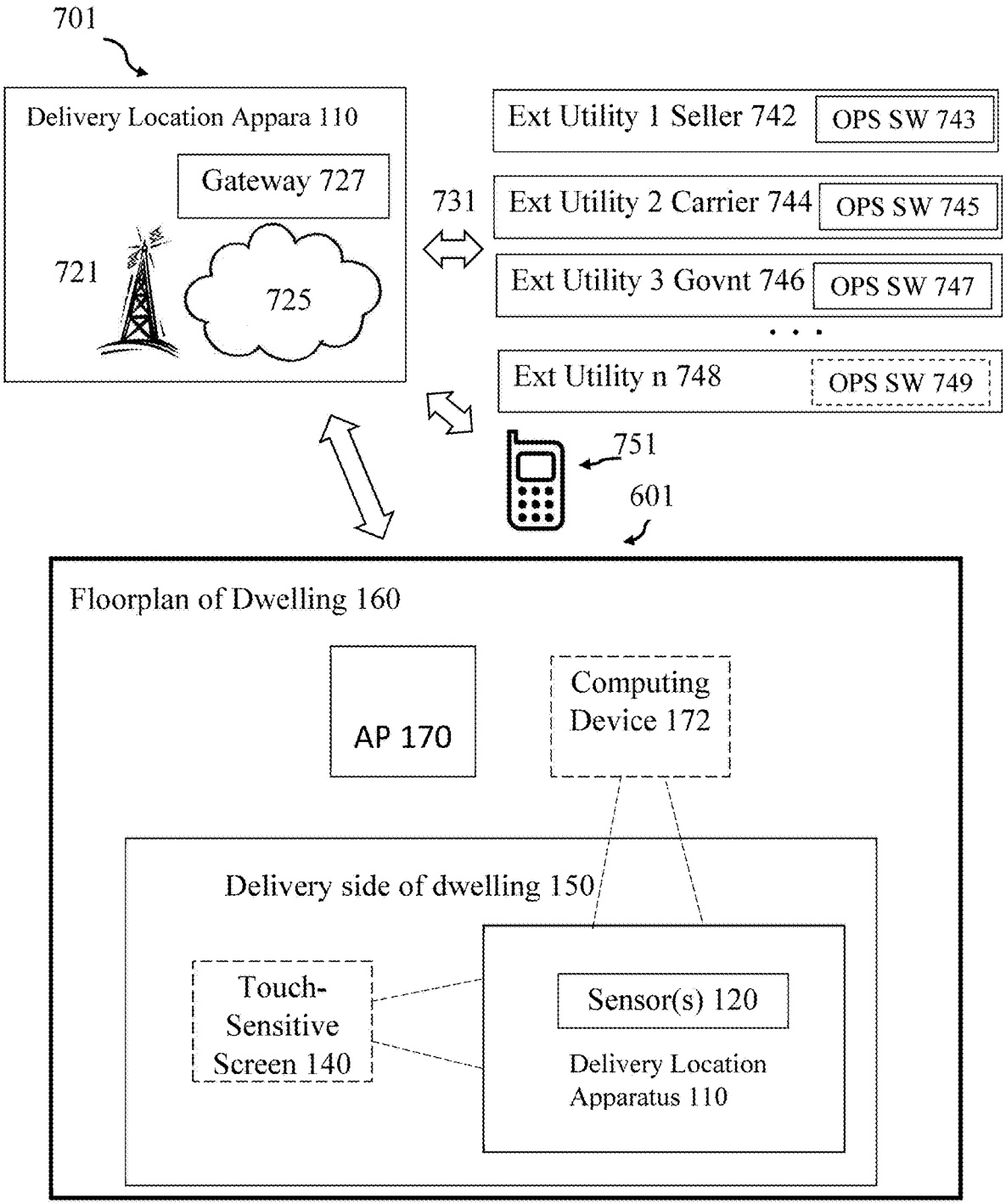
FIG. 7 illustrates a computing system implementing an order planning system according to this disclosure.

In various implementations, the computer system may be a uniprocessor system including one processor, or a multiprocessor system including several processors (e.g., two, four, six, eight, or another suitable number). The processors may be any suitable processor capable of executing instructions. For instance, the one or more processors may be associated with external utility 742, 744, 746, and/or 748 depicted in FIG. 7. These processors may be a server class processor, or other processor configured for executing control instructions associated with general purpose operating system and control applications. As previously explained, FIG. 1 shows an illustrative embodiment porch piracy delivered parcel theft prevention system 101 comprising a delivery location apparatus 110 and a computing system which includes external utility 180 alone or in combination with computing device 172 implementing an order planning system 181 in network communication with the delivery location apparatus 110. FIG. 7 shows a plurality of external utilities 742, 744, 746, 748 including individualized order planning system. For example, external utility 1 Seller 742 may be one online store and external utility n 748 may be another online seller. Each seller may implement their own individualized order planning system. The user may access any one or more of the individualized utilities depicted in FIG. 7 directly through hardware software accessible by the controller 130 required to effect communications with each utility. Alternatively, the individualized utilities may be gated through an intermediary utility with which the controller 130 of the location may be configured to communicate. In another embodiment, the utility depicted in FIG. 1 may serve the utilities depicted in FIG. 7 for purposes of effecting communications between individual utilities with order planning systems and controller 130 of the delivery location apparatus. This disclosure discloses one or more utilities with order planning systems communicating with the controller 130 of the delivery location apparatus 110 to provide the porch piracy parcel theft prevention system and method of this disclosure.

Memory of the computing system may be a server class memory, or other memory configured for storing control instructions associated with general purpose operating system and control applications. These instructions are illustratively depicted in one embodiment shown in FIG. 1 as OPS SW 181. FIG. 7 depicts a distributed operation systems software architecture wherein seller, carrier, government, and other entities employ operating system SW 743, 745, 747, and 749, respectively.

At least some of the software and data structures stored in the memory 1130 of the wireless device 1120 may implement a general-purpose operating system that functionally organizes the computing devices on the operating system like the delivery location apparatuses in the system. The general-purpose operating system may be a type of operating system, that is capable of executing a variety of types of software applications, including applications related to delivery location apparatus control. At least part of the software and data structures in the memory of the computer system stores the control application that is utilized to control the delivery location apparatus and other devices as disclosed herein.

FIG. 7 shows the system depicted in the FIG. 1 embodiment but with several utilities in bidirectional communication with delivery location apparatus through a network which is depicted as an internet network by cloud 725 but may be any public or private network. In FIG. 7, the network depicts the delivery location apparatus 110 in bidirectional communication through cloud 330 with 372, 374, 376 378 with a seller utility 742, a delivery service utility 744, a government external utility 744, or other external utility(s) 748, such as the police.

The delivery location apparatus 110 is also in bidirectional communication through cloud 330 with a mobile computing device 751 of a person. The person may be the owner of the dwelling wherein resides the delivery location apparatus 110. Alternatively, it may be a person authorized to receive deliveries at the dwelling or building or residential or commercial building wherein resides the delivery location apparatus 110. Bidirectional communication between the delivery location apparatus and the mobile computing device 751 enables alarms or other events to be communicated from the delivery location apparatus to the mobile computing device and for the mobile computing device to send communications to the delivery location apparatus. For instance, if a person receives an alert that the alarm has been triggered, the person may communicate responsive actions to the delivery location apparatus such as to alert specific persons or entities that the homeowner or authorized person may have programmed into the memory bank of the delivery location apparatus. These programmed contacts may be different from contacts that the homeowner or authorized person may have provided to the external utility 180. As another example, the user of the mobile computing device may use his or her mobile computing device to communicate other responsive actions such as to make cellular or other calls to persons who may help address the alarm.

FIGS. 8, 9 disclose an illustrative operation of the system and method of this disclosure. FIG. 8 depicts a parcel delivery to a house. In FIG. 8A, the sensor 120 of the delivery location apparatus 110 of this disclosure lies below the horizontal axis running through the doorknob of door 150. In FIG. 8A1, a carrier is seen approaching a house. The carrier is carrying a parcel 805 towards the delivery side of a dwelling 150. The house is provided with the sensor 120 of this disclosure. FIG. 8A2 depicts the same house a period of time later after delivery of the parcel. The parcel 805 is shown to be placed on the ground in front of the sensor 120. The carrier is nowhere to be seen since he has finished delivery of the parcel and moved on to another delivery.

In FIG. 8B, the sensor 120 of the delivery location apparatus 110 of this disclosure lies above the horizontal axis running through the doorknob of door 150. Also in FIG. 8B, a ledge 121 is firmly mounted to the house below the sensor 120 in order to receive and hold the parcel within the FOV of the sensor 120. The ledge may be long and wide enough to support the type of parcels expected to be delivered to the house. The ledge may be mounted so firmly as to support the load of one or more parcels placed on the ledge in the FOV of the sensor 120. In FIG. 8B1, a carrier is seen approaching a house. The carrier is carrying a parcel 805 towards the delivery side of a dwelling 150. The house is provided with the sensor 120 of this disclosure. FIG. 8B2 depicts the same house a period of time later after delivery of the parcel. The parcel is shown to be placed on the ledge in front of the sensor 120. The carrier is nowhere to be seen since he has finished delivery of the parcel and moved on to another delivery.

FIG. 9A1 depicts the house shown in FIG. 8A with parcel 805 placed in the field of vision of the sensor 120. FIG. 9A2 shows a side view of the placement of the parcel to illustrate the placement of the parcel into the field of view of the sensor 120.

Figure 10:
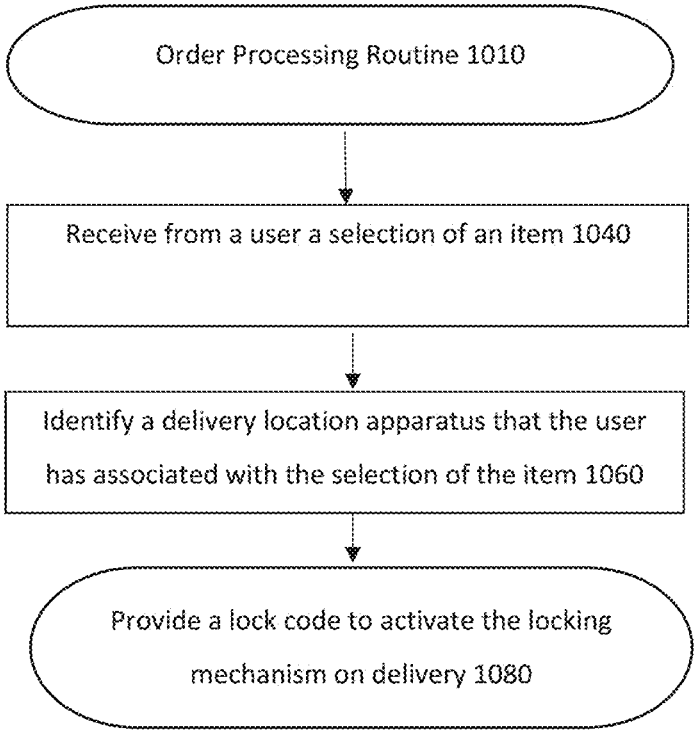
FIGS. 10-13 disclose illustrative methods of this disclosure.

Turning now to control of the porch piracy delivered parcel theft prevention system, one illustrative embodiment is depicted in FIG. 10. FIG. 10 is a flow diagram illustrating an illustrative process 1010 for processing an order by a user for an item. The process may be implemented in hardware, software, or a combination thereof. The process 1010 starts upon receiving from a user a selection of an item. 1040. Upon receiving a purchase request of an item from the user, a determination is made as to the delivery location that the user has associated with the item selected. 1060. On identifying the delivery location apparatus to receive the ordered item, a lock code is provided to a carrier to activate the locking mechanism on the delivery location apparatus on delivery 1080.

Simply put, the memory stores program instructions that when executed by the one or more processors cause the one or more processors to at least: receive from a user a selection of an item 1040; identify a delivery location apparatus that the user has associated with the selection of the item 1060; associate the delivery of the item with the delivery location apparatus so that the item will be delivered to the delivery location apparatus adapted to the building to enable the user to go to the delivery location and to remove the item from the line of sight of the parcel detecting sensor while the user is at the delivery location; and provide a lock code 1080 to enable the person delivering the parcel to the delivery location apparatus to activate the locking mechanism of the delivery location apparatus after placing the parcel in the line of sight of the parcel detecting sensor.

Referring to FIGS. 1 and 10, the controller 130 of the delivery location apparatus 110, in response to a receipt of the lock code from the person delivering the parcel to the delivery location apparatus 110 after placing the parcel in the line of sight of the parcel detecting sensor 120, controls the locking mechanism 135 to activate the locking mechanism of the delivery location apparatus 110 to place the locking mechanism 135 into a locked position.

The removal of the parcel from the line of sight of the parcel detecting sensor 120 while the locking mechanism 135 is in the locked position triggers an alarm.

Figure 11:
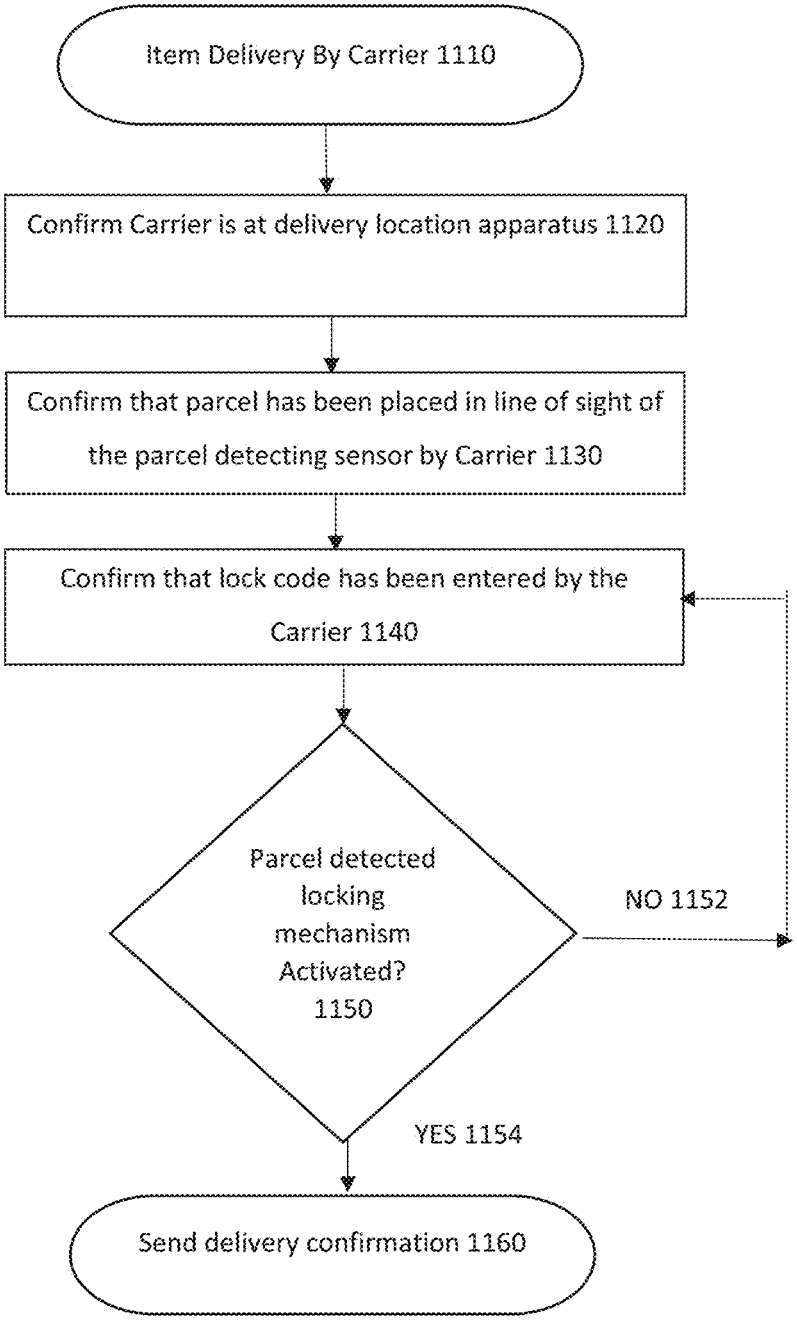

FIG. 11 is a flow diagram illustrating an illustrative process 1110 for processing a delivery by a carrier of an item ordered by a user. The process may be implemented in hardware, software, or a combination thereof. The process 1110 starts upon confirming the carrier is at the delivery location designated to receive the ordered item 1120. Upon confirmation, the process confirms that the parcel containing the ordered item has been placed in the line of sight of the parcel detecting sensor by the carrier 1130. Upon confirmation, the process confirms that the lock code has been entered by the carrier 1140. If the delivery location apparatus 110 is provided with a UI, e.g., touch sensitive screen 140, the lock code may be entered by the carrier manually using the keypad on the UI, e.g., the touch sensitive screen 140. Alternatively, the lock code may be entered onto a UI, e.g., touch screen of a mobile computing of the carrier and wireless transmitted to communication module 134 of the delivery location apparatus 110. Upon confirmation that the lock code has been entered by the carrier 1140, a determination is made as to whether the parcel detected locking mechanism has been activated 1150. If the parcel detected locking mechanism has not been activated 1152, the process checks again to see if the lock code has been entered by the carrier. If the parcel detected locking mechanism remains not activated, the process may perform diagnostics, alert the carrier, alert the user, take remedial measures, and so on. If the parcel detected locking mechanism has been activated 1154, the process sends a delivery confirmation message to the user 1160.

Simply put, in FIG. 11, the memory stores program instructions that when executed by the one or more processors further cause the one or more processors to: confirm the carrier is at delivery location apparatus 1120, confirm that the parcel has been placed in line of sight of the parcel detecting sensor by Carrier 1130; confirm that lock code has been entered by the Carrier 1140; determine whether the parcel detected locking mechanism is activated 1150; and send delivery confirmation 1160.

Figure 12:
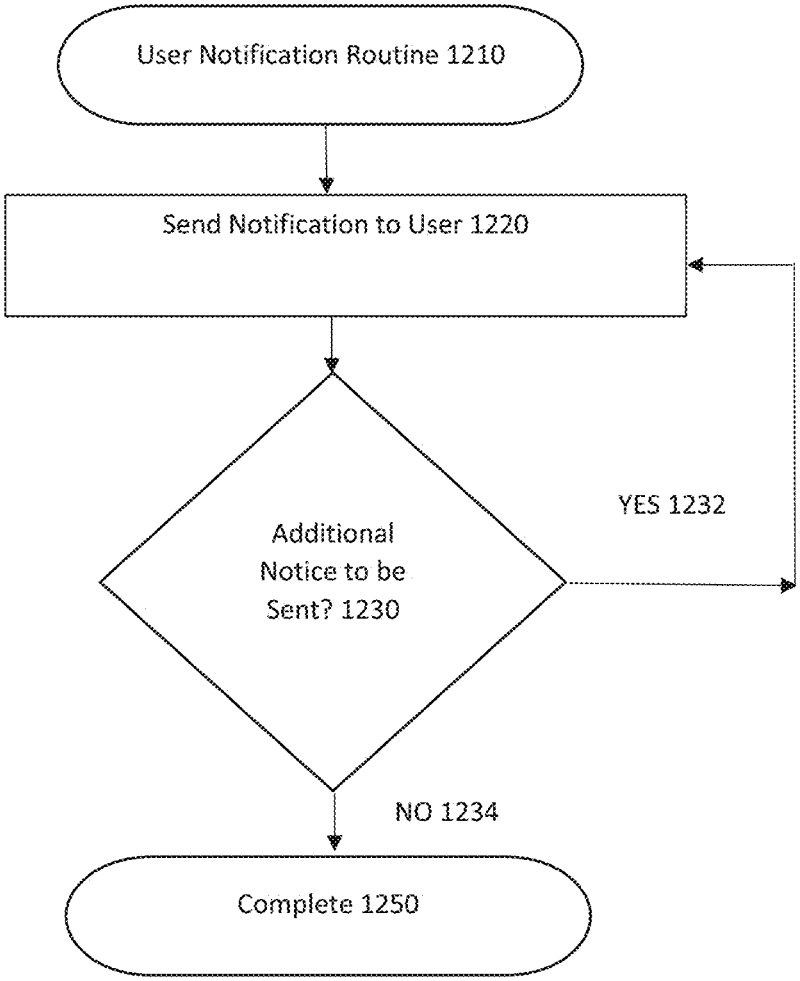

FIG. 12 is a flow diagram illustrating an illustrative process 1210 for notifying a user about the delivery of an item ordered by a user. The process may be implemented in hardware, software, or a combination thereof. The process begins with sending notification to a user about the item delivery of an item 1220. For example, the notification may inform the user that the item ordered by the user has begun delivery. As another example, the notification may inform the user that the carrier has delivered an item ordered by a user. The process provides for sending additional notices to the user as may be needed 1230. For example, a notification 1220 may prompt the user that the carrier has tried to make a delivery but there was a problem activating the parcel detecting locking mechanism. The additional notice 1230 may then provide a follow up message on the status of the delivery, such as wait 5 minutes for an update while diagnostics is being run or parcel detecting locking mechanism is malfunctioning, go to a predetermined location for parcel pick-up. The process may also employ messaging via text, voice, email, or other messaging medium to interact with the user to advance the delivery process.

Simply put, in FIG. 12 of a user notification routine 1210, the memory stores program instructions that when executed by the one or more processors cause the one or more processors to: send a user notification routine 1220, determine whether additional notices need to be sent 1230, send additional notices 1232, and complete the user notification routine 1210.

Figure 13:
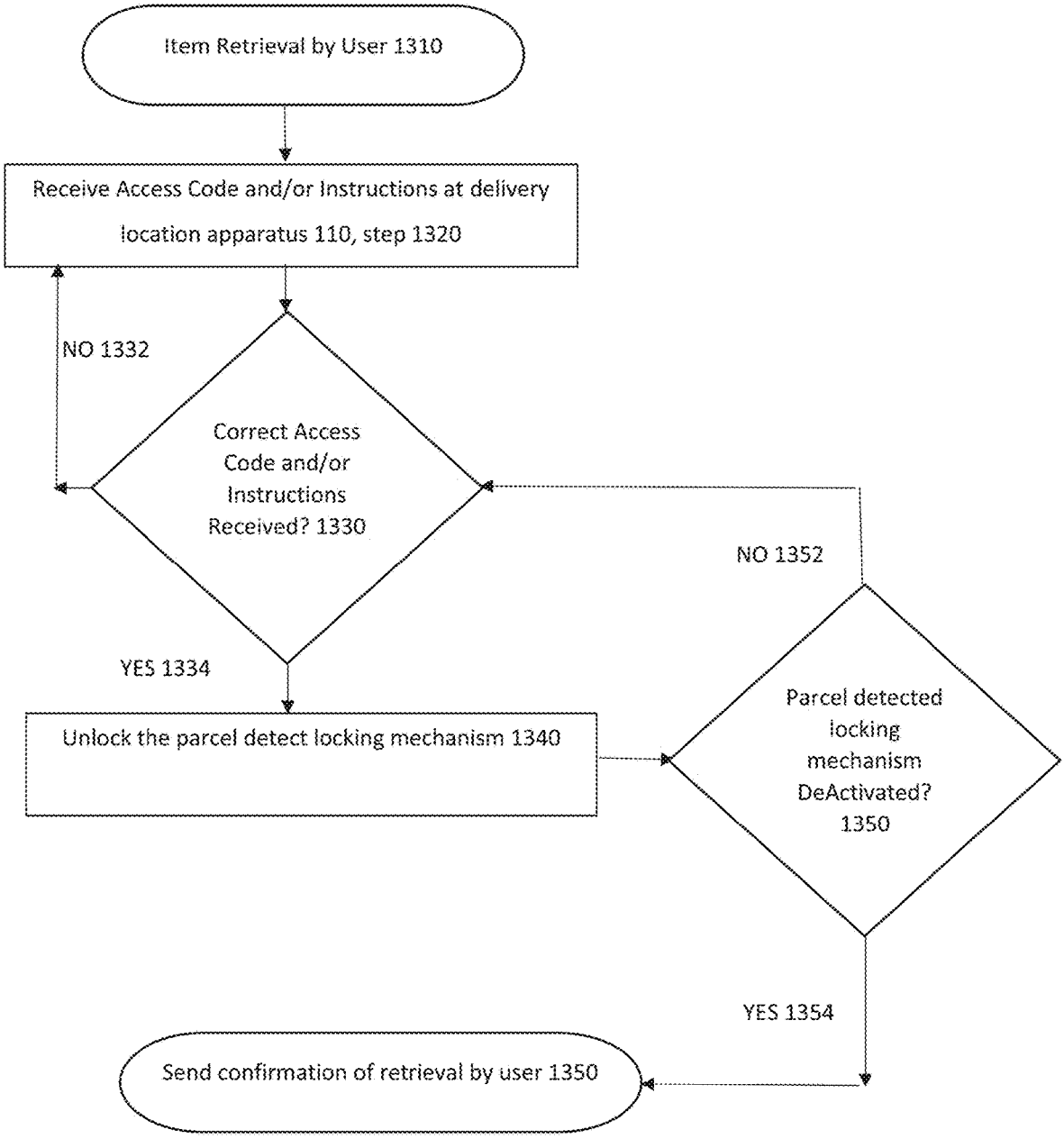

FIG. 13 is a illustrating an illustrative process 1110 for processing a delivery by a carrier of an item ordered by a user. The process may be implemented in hardware, software, or a combination thereof. The process begins with receiving access code and/or instructions at delivery location apparatus 110, step 1320. The conjunctive and disjunctive may allow for instructions to be provided to unlock the parcel detect locking mechanism. For instance, if a user has lost or forgotten the access code, a user may provide information to a service provided by one of the external servers of seller 742, carrier 744, government, or other service providers (see FIG. 7). Information such as the identity of the user purchasing the parcel, the identity of the delivery location apparatus 110 to which the parcel is to be delivered, the particulars on the parcel to be delivered, and so on. The information may validate the user as authorized to receive the parcel. The process determines if the correct access code and/or instructions are received 1330. If the process determines that the access code and/or instructions received are not correct 1332, the process may return 1332 to step 1320 to receive access code and/or instructions. The process may also use the user notification routine 1210 to send notifications to the user about the status of the process. The process may also employ messaging via text, voice, email, or other messaging medium to interact with the user to advance the delivery process. If the process determines that the access code and/or instructions received are correct 1334, the process unlocks the parcel detect locking mechanism 1340.

The process determines if the parcel detected locking mechanism is deactivated 1150. If the process determines that the parcel detected locking mechanism is not deactivated 1352, the process may return to step 1330 to determine if the access code and/or instructions are correct. The process may also use the user notification routine 1210 to send notifications to the user about the status of the process. The process may also employ messaging via text, voice, email, or other messaging medium to interact with the user to advance the delivery process. If the process determines that the parcel detected locking mechanism is deactivated 1350, the process sends confirmation of retrieval by user 1350.

The process may also determine, for example after a predetermined period of time, whether the parcel is removed from the line of sight of the parcel detecting sensor by the user (not shown). If the parcel has not been removed, the user notification routine 1210 may be used to notify the user that the parcel has not been removed from the unlocked parcel detected locking mechanism. The process may also employ messaging via text, voice, email, or other messaging medium to interact with the user on this action or any other actions to advance the delivery process.

The user notification routine 1210 and messaging via text, voice, email, or other messaging medium may be used to interact with the carrier, the user, or any other participant in the delivery process about the delivery, including for example, feedback on a service or parcel, or other information impacting upon the delivery and process.

Simply put, in FIG. 13 of an item retrieval by user routine 1310, the memory stores program instructions that when executed by the one or more processors cause the one or more processors to: receive Access Code and/or Instructions at delivery location apparatus 1320; determine whether correct access code and/or instructions have been received 1330; if correct access code and/or instructions have been received, to unlock the parcel detect locking mechanism 1340; and determine if parcel detected locking mechanism is deactivated 1350.

As previously explained, FIG. 14 depicts illustrative security-loaded pins or codes in three columns of a memory map for operating the parcel detected locking mechanism 135 (FIG. 1) by individual, issued code, and the state of the alarm, respectively, in one illustrative embodiment. In FIG. 14A embodiment, delivery carrier 1402 is issued a code 1412 for delivery which sets alarm 1422. Turning now to the use of the codes, FIG. 14A shows codes useable by a carrier and a user in this disclosure.

To arm locking mechanism 135, as shown in FIG. 14A, and referring to FIGS. 1-9, a delivery carrier 1402 may at the time of delivery of a purchased item place the parcel before the sensor 120 of FIGS. 8 and 9 and manually enter code 1412 that he or she was issued for the delivery into delivery location apparatus 110 via, for example touch screen 140 or other UI (e.g., an iPad of the delivery carrier that is in communication with the controller 130) for processing by processor 131 and/or a processor in computing device 172 and storage in memory 132 or a memory located in computing device 172. Alternatively, code 1412 may be wirelessly communicated to delivery location apparatus 110 via communication module 134 in controller 130 and/or computing device 172 for display on UI 140 or a UI of the carrier (e.g., a UI of courier's iPad) on receipt of the carrier's credentials. This code may be noted and entered by the carrier into UI 140 or a UI of the carrier (e.g., an iPad of the delivery carrier that is in communication with the controller 130) after the parcel is placed into the line of sight of the parcel detecting sensor. The code arms the locking mechanism 135 into a locked position, that is to say, the code sets the alarm 1422.

The alarm is triggered on the removal of the parcel from the line of sight of the parcel detecting sensor while the locking mechanism is in the locked position. The alarm that is triggered on the removal of the parcel from the line of sight of the parcel detecting sensor while the locking mechanism is in the locked position may be an audible alarm, an activation of a light source, an alert transmitted to the seller of the item, an alert sent to authorities, an alert sent to a service, an alert sent to the person associated with the delivery location apparatus, and so on. The alarm may be selected from the group consisting of an audible alarm, an activation of a light source, an alert transmitted to the seller of the item, an alert sent to authorities, an alert sent to a service, and an alert sent to the person associated with the delivery location apparatus.

A homeowner or other authorized person 1403 may at the time of a purchase of an item receive a homeowner code 1413 that is associated with the item to be delivered to the delivery location device 172. To disarm locking mechanism 135, as shown in FIG. 14A, and referring to FIGS. 1-9, the user must move the locking mechanism from a locked position to an unlocked position, The user does this by manually entering homeowner code 1413 issued for pick-up into delivery location apparatus 110 via, for example touch screen 140 or other UI (e.g., a smartphone of the user that is in communication with the controller 130) for processing by processor 131 and/or a processor in computing device 172 and storage in memory 132 or a memory located in computing device 172. Alternatively, code 1413 may be wirelessly communicated to delivery location apparatus 110 via communication module 134 in controller 130 and/or computing device 172 for display on UI 140 or a UI of the user (e.g., a UI of smartphone) on receipt of the user's credentials. This code may be noted and entered by the user before the parcel is removed from the line of sight of the parcel detecting sensor. The code moves the locking mechanism into an unlocked position, that is to say, the code disarms the alarm 1422.

As previously explained, the alarm is triggered on the removal of the parcel from the line of sight of the parcel detecting sensor while the locking mechanism is in the locked position.

If the package is removed from the light source or camera without first disabling the alarm, such as would occur where the removal of the package is part of a theft, the alarm may sound and continue sounding until deactivated. The sounding of the alarm will alert those in the area of the theft so that they may take action to prevent it. The alarm may also be communicated throughout the network so that other computing devices on the network are aware of the theft so that they too may take action. These other computing devices may be of family and friends of the user as well as government authorities like police as well as the seller.

As also previously explained, the alarm that is triggered on the removal of the parcel from the line of sight of the parcel detecting sensor while the locking mechanism is in the locked position may be an audible alarm, an activation of a light source, an alert transmitted to the seller of the item, an alert sent to authorities, an alert sent to a service, an alert sent to the person associated with the delivery location apparatus, and so on. The alarm may be selected from the group consisting of an audible alarm, an activation of a light source, an alert transmitted to the seller of the item, an alert sent to authorities, an alert sent to a service, and an alert sent to the person associated with the delivery location apparatus.

As previously explained, the alarm activated schema for parcel detected locking mechanism 135 with illustrative security-loaded pins or codes depicted in FIG. 14B involve setting of two conditions. Seller 1401 is issued code 1411 at time of sale which is used to set condition 1 for alarm 1421. Delivery carrier 1402 is issued code 1412 to set condition 2 for the alarm 1422. Turning now to the use of the codes, referring now to FIG. 14B, in connection with FIGS. 1-9, a delivery carrier 1402 may at the time of delivery of a purchased item place the parcel before the sensor 120 of FIGS. 8 and 9 and manually enter delivery carrier code 1412 issued for delivery into delivery location apparatus 110 via, for example touch screen 140 or other UI (e.g., an iPad of the carrier that is in communication with the controller 130) for processing by processor 131 and/or a processor in computing device 172 and storage in memory 132 or a memory located in computing device 172. Alternatively, code 1412 may be wirelessly communicated to delivery location apparatus 110 via communication module 134 in controller 130 and/or computing device 172 for display on UI 140 or a UI of the carrier (e.g., a UI of courier's iPad) on receipt of the carrier's credentials. This code may be entered after the parcel is placed into the line of sight of the parcel detecting sensor. The code arms the locking mechanism into a locked position, that is to say, the code sets the alarm 1422. As indicated in FIG. 14B, code issued for delivery 1412 sets a condition 2 for triggering the alarm 1422.

Still referring to FIG. 14B, and referring to FIGS. 1-9, a seller 1401 may receive a code issued at the time of sale 1411. The code may be generated by the computing system implementing the order planning system. The computing system implementing the order planning system may associate the code issued seller at time of sale 1411 with the delivery location apparatus 110. Code 1411 may set a condition 1 for triggering the alarm.

Code 1411 may be communicated, for example, wirelessly to carrier for entry into the delivery location 110. For example, code 1411 may be wirelessly transmitted to a mobile computing device of a carrier, such as an iPad. Alternatively, code 1411 may be transmitted to the carrier via the touch screen display screen 140 after the carrier has entered credentials used by the computing system to validate the carrier. Code 1411 may be communicated to the carrier by the seller or for the seller by another person authorized by the seller. Code 1411 thus stands as a code separate and apart from carrier code 1412 for providing additional verification that the handling of the parcel is by an authorized person, in the instant illustrative example, a carrier, but in another embodiment explained below, a homeowner.

The carrier may at the time of delivery of a purchased item place the parcel before the sensor 120 of FIGS. 8 and 9 manually enter code 1411 into delivery location apparatus 110 via, for example touch screen 140 or other UI (e.g., iPad of the carrier in communication with the controller) for processing by processor 131 and/or a processor in computing device 172 and storage in memory 132 or a memory located in computing device 172.

The carrier would also enter the carrier code 1412 and the entry of both seller code 1411 and carrier code 1412 would arm the parcel detecting sensor.

In this example, it is seen that seller code 1411 may be assigned to a carrier to enter which he or she may do so along with the carrier code 1412 after the parcel is placed into the line of sight of the parcel detecting sensor. In this example, the two codes provide two credentials or conditions required for arming the alarm. Entry of the credentials arm the locking mechanism into a locked position, that is to say, the codes set the conditions 1421 and 1422 for the arming the alarm. As indicated in FIG. 14B, code issued at sale 1411 sets condition 1 for setting the alarm 1421 and the code issued for delivery 1412 sets condition 2 for setting the alarm.

As previously explained in connection with FIG. 14A and also applicable to FIG. 14B, a homeowner or other authorized person 1403 may at the time of a purchase of an item receive a homeowner code 1413 that is associated with the item to be delivered to the delivery location device 172.

In another embodiment, code 1411 of the seller may be wirelessly transmitted to a mobile computing device of a homeowner, such as an iPhone, instead of giving it to the carrier. Alternatively, code 1411 may be transmitted to the home owner via the touch screen display screen 140 after the home owner has entered credentials used by the computing system to validate the home owner. The home owner may prior to removal of a purchased item from field of view of the sensor 120 of FIGS. 8 and 9 manually enter code 1411 into delivery location apparatus 110 via, for example touch screen 140 or other UI (e.g., smartphone of the user in communication with the controller) for processing by processor 131 and/or a processor in computing device 172 and storage in memory 132 or a memory located in computing device 172.

Alternatively, code 1411 may be wirelessly communicated to delivery location apparatus 110 via communication module 134 in controller 130 and/or computing device 172. The home owner may then enter code 1411 which was provided to the homeowner into delivery location apparatus 110 via, for example touch screen 140 or other UI (e.g., smartphone of the user in communication with the controller) for processing by processor 131 and/or a processor in computing device 172 and storage in memory 132 or a memory located in computing device 172. In this embodiment, Code 1411 which stands as a code separate and apart from homeowner code 1413 for providing additional verification that the handling of the parcel is by an authorized person, in the instant illustrative example, a homeowner.

The homeowner would also enter the homeowner code 1413 and the entry of both seller code 1411 and homeowner code 1413 would disarm the parcel detecting sensor.

In this example it is seen that the seller code 1411 may be assigned to a homeowner to enter which he or she may do so along with the homeowner code 1413 before the parcel is removed from the line of sight of the parcel detecting sensor. In this example, the two codes of seller code and homeowner code provide two credentials or conditions required for disarming the alarm. Entry of the credentials disarm the locking mechanism into an unlocked position, that is to say, the codes disarm the alarm 1422 set by the carrier.

As previously explained, the alarm activated schema for parcel detected locking mechanism 135 with illustrative security-loaded pins or codes depicted in FIG. 14C involve setting of two conditions. The schema is similar to that schema explained in FIG. 14B save for code 1413 of the homeowner which in FIG. 14C is created by the homeowner. Turning now to the use of the codes, FIG. 14C, in connection with FIGS. 1-9, shows security codes for arming and disarming an alarm that is similar to the security coding explained in connection with FIG. 14B except that the homeowner code is not issued to the homeowner; rather it is created by the homeowner. For example, in FIG. 14B, the homeowner code may be an identifier created by the computer system including alpha, numeric, function and/or other identifiers. Alternatively, it may be randomly generated by the computer system. The homeowner code may be issued at the time of purchase or later and transmitted to the homeowner illustratively wirelessly such as to the homeowner's mobile phone.

In the embodiment in FIG. 14C, the homeowner code may be an identifier created by the homeowner including alpha, numeric, function and/or other identifiers and provided to the computing system. In one embodiment, the homeowner creates an account with the order planning system implemented by the computing system and uses the password for the account as the homeowner code. In another embodiment, the homeowner creates and provides the order planning system with a homeowner code at the time of purchase or later. The homeowner may use the same password for the homeowner code as the security system the homeowner may have installed at the premises of the homeowner.

In another embodiment, the security system installed on the premises of the homeowner may be integrated into the computing system to provide a single security platform for protecting both the premises and delivered packages of the homeowner.

In either embodiments illustrated in FIG. 14, the alarm is triggered on the removal of the parcel from the line of sight of the parcel detecting sensor while the locking mechanism is in the locked position. The alarm that is triggered on the removal of the parcel from the line of sight of the parcel detecting sensor while the locking mechanism is in the locked position may be an audible alarm, an activation of a light source, an alert transmitted to the seller of the item, an alert sent to authorities, an alert sent to a service, an alert sent to the person associated with the delivery location apparatus, and so on. The alarm may be selected from the group consisting of an audible alarm, an activation of a light source, an alert transmitted to the seller of the item, an alert sent to authorities, an alert sent to a service, and an alert sent to the person associated with the delivery location apparatus.

Figure 15C:
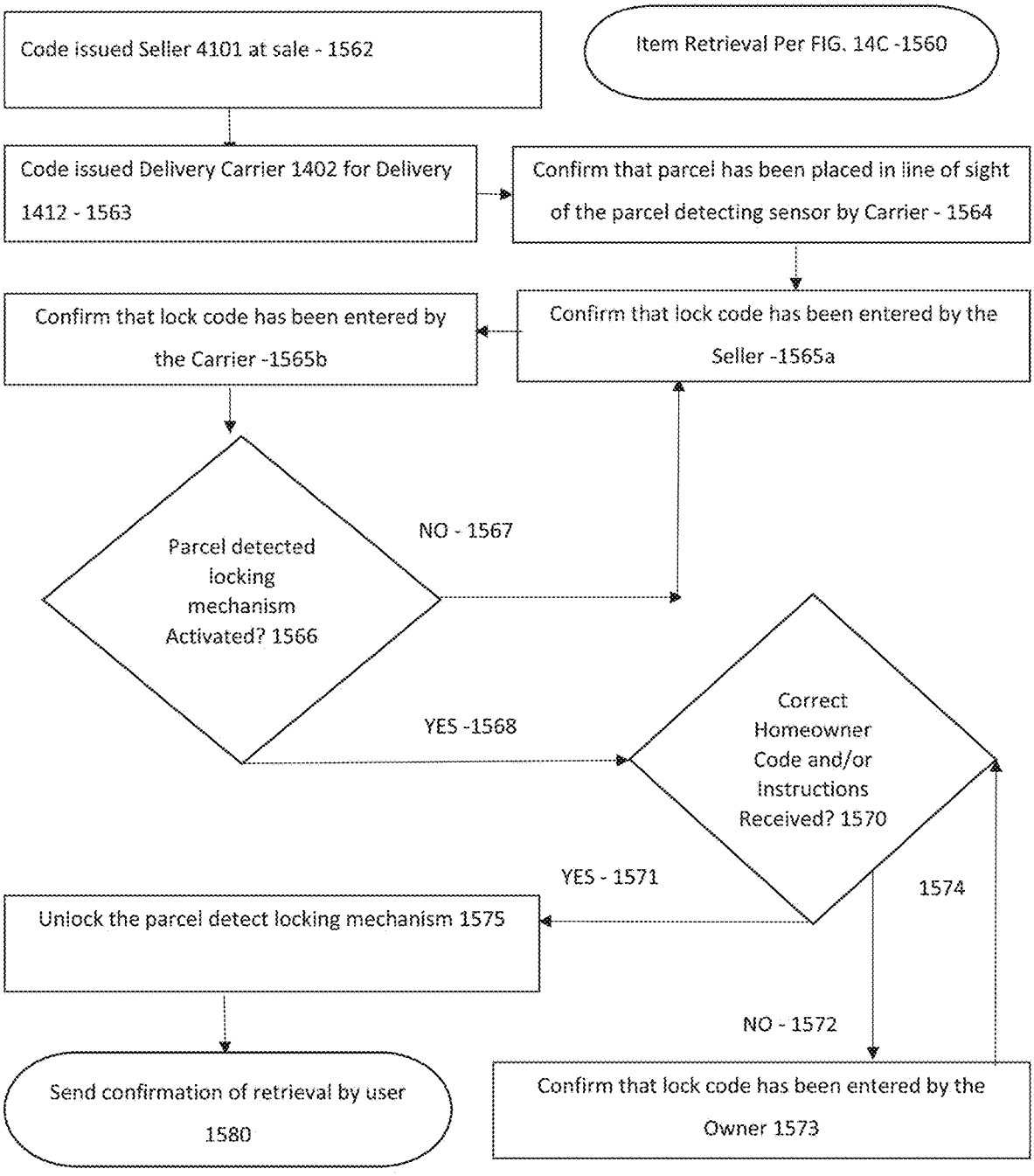

FIGS. 15A, 15B, and 15C illustrate methods employing the security coding disclosed in connection with FIG. 14.

FIG. 15A is a illustrating an illustrative item retrieval according to one illustrative embodiment of FIG. 14A process 1510 for processing a delivery by a carrier of an item ordered by a user. The process may be implemented in hardware, software, or a combination thereof. The process begins with carrier receiving Code issued Delivery Carrier 1402 for Delivery 1412-1512. The process confirms that parcel has been placed in line of sight of the parcel detecting sensor by Carrier—1514. The process confirms that lock code has been entered by the Carrier—1515. The process determines if Parcel detected locking mechanism 1422 Activated 1516. If NO 1517, the process confirms that lock code has been entered by the Carrier—1515. If YES 1518, the process determines whether correct Homeowner Code and/or Instructions Received 1520. If NO, the process Confirm that lock code has been entered by the Owner 1523 and then determines whether correct Homeowner Code and/or Instructions Received 1520. If YES, the process unlocks the parcel detect locking mechanism 1423-1525. The process ends by Sending confirmation of retrieval by user 1529.

FIG. 15B is a illustrating an illustrative item retrieval according to one illustrative embodiment of FIG. 14B process 1530 for processing a delivery by a carrier of an item ordered by a user. The process may be implemented in hardware, software, or a combination thereof. The process begins with seller receiving Code issued Seller 4101 at sale—1532. The process continues with carrier receiving Code issued Delivery Carrier 1402 for Delivery 1412-1533.

The process confirms that parcel has been placed in line of sight of the parcel detecting sensor by Carrier—1534. The process confirms that lock code has been entered by the Seller-1535*a*. The process confirm that lock code has been entered by the Carrier—1535*b*. The process determines whether Parcel detected locking mechanism Activated 1536. If NO, the process confirms that lock code has been entered by the Seller—535*a*. If YES, the process determines whether correct Homeowner Code and/or Instructions Received 1540. If NO, the process confirms that lock code has been entered by the Owner 1543 and then determines whether correct Homeowner Code and/or Instructions Received 1540. If YES, the process unlocks the parcel detect locking mechanism 1545. The process ends by Sending confirmation of retrieval by user 1550.

FIG. 15C is a illustrating an illustrative item retrieval according to FIG. 14C process 1560 for processing a delivery by a carrier of an item ordered by a user. The process may be implemented in hardware, software, or a combination thereof. The process is like the process of FIG. 15B except that the homeowner code is not issued to the homeowner; rather it is created by the homeowner as previously explained.

FIG. 16 illustrates an embodiment of this disclosure employing camera as the sensor. FIG. 16A shows parcel 1620 captured on pixels 1640 of the field of vision of an image sensor. FIG. 16B shows two parcels, namely, a parcel 1630 on top of a parcel 1620 captured on pixels 1660 and 1650, respectively, of the field of vision of the image sensor. FIG. 16B may illustrate what the pixels of the image sensor detect at time t=t1. FIG. 16A may illustrate what the pixels of the same image sensor detect at time t=t2. In other words, the same image sensor is capturing two images at different points in time. If the images are discernably the same, the camera perceives there to have been no movement. If the images are discernably different, the camera perceives there to have been movement. In the instant example, a comparison of the image at time t=t1 showing two parcels 1620, 1630 to the image at time t=t2 showing one parcel 1620 indicate the two images to be discernably different in that parcel 1630 is missing in the image captured at time t=t2. The discernable difference between images in going from time t=t1 to time t=t2 is recognized as there having been a movement of an object within its field of vision. The specific movement is the removal of parcel 1630 from the image. In one embodiment, a motion detect algorithm may be employed to detect this motion from the video cameras. The algorithm may use a compare last frame versus the new frame obtained from the video camera at different time periods. The last frame for each video camera is therefore kept in memory at separate memory locations. When the software starts the image map is loaded in memory for the camera to do real-time motion detection.

When armed, the parcel locking mechanism is configured to trigger an alarm when the parcel detected locking mechanism detects removal of the parcel from the line of sight of the parcel detecting sensor as it would in the example depicted in FIG. 16. When disarmed, the package may be removed from the line of sight of the parcel detecting sensor without tripping the alarm.

There is thus disclosed a porch piracy parcel theft prevention system and method includes a delivery location apparatus configured for attachment to a building to receive a parcel, the delivery location apparatus including a sensor and a parcel locking mechanism. The sensor is configured to detect the presence of a delivered parcel placed into the line of sight of the parcel detecting sensor. The parcel locking mechanism is armed upon entry of a carrier code and disarmed upon entry of a user code. When armed, the parcel locking mechanism is configured to trigger an alarm when the parcel detected locking mechanism detects removal of the parcel from the line of sight of the parcel detecting sensor. When disarmed, the package may be removed from the line of sight of the parcel detecting sensor without tripping the alarm. Among other uses, helps prevent parcel theft from single family dwellings. The uses help prevent parcel theft from any house, apartment, dwelling, residential building, commercial building, or any other building where deliveries may be made.

In one aspect, a porch piracy delivered parcel theft prevention system includes a delivery location apparatus that is associated with and configured to be attached to a building to receive a parcel, the delivery location apparatus and a computing system implementing an order planning system. The delivery location apparatus includes a parcel detecting sensor, a parcel detected locking mechanism, a controller and a mounting mechanism. The parcel detecting sensor is configured to detect a parcel when the parcel is placed in a line of sight of the parcel detecting sensor. The parcel detected locking mechanism is configured to trigger an alarm when, in a locked position, the parcel detected locking mechanism detects removal of the parcel placed in the line of sight of the parcel detecting sensor. The controller is configured to control the parcel detected locking mechanism and includes an input device. The mounting mechanism is configured to attach the delivery location apparatus to an outside surface of the building to enable a user to retrieve an item from the line of sight of the parcel detecting sensor while the user is at the delivery location; The computing system implementing an order planning system includes one or more processors and a memory coupled to the one or more processors. The memory stores program instructions that when executed by the one or more processors cause the one or more processors to at least: receive from a user a selection of an item; identify a delivery location apparatus that the user has associated with the selection of the item; associate the delivery of the item with the delivery location apparatus so that the item will be delivered to the delivery location apparatus adapted to the building to enable the user to go to the delivery location and to remove the item from the line of sight of the parcel detecting sensor while the user is at the delivery location; and provide a lock code to enable the person delivering the parcel to the delivery location apparatus to activate the locking mechanism of the delivery location apparatus after placing the parcel in the line of sight of the parcel detecting sensor. The controller of the delivery location apparatus, in response to a receipt of the lock code from the person delivering the parcel to the delivery location apparatus after placing the parcel in the line of sight of the parcel detecting sensor, controls the locking mechanism to activate the locking mechanism of the delivery location apparatus to place the locking mechanism into a locked position. The removal of the parcel from the line of sight of the parcel detecting sensor while the locking mechanism is in the locked position triggers an alarm.

In another aspect, a lock code is manually entered into the delivery parcel theft prevention system via the input device.

In another aspect, the input device is a touch sensitive screen attached to the building in proximity to the parcel detecting sensor In another aspect, the memory coupled to the one or more processors and storing program instructions that when executed by the one or more processors further cause the one or more processors to provide an unlock code to the user enable the user to deactivate the locking mechanism of the delivery location apparatus to place the locking mechanism into an unlocked position before removing the parcel from the line of sight of the parcel detecting sensor. The removal of the parcel from the line of sight of the parcel detecting sensor while the locking mechanism is in the unlocked position does not triggers the alarm.

In another aspect, the memory coupled to the one or more processors and storing program instructions that when executed by the one or more processors further cause the one or more processors to provide a first lock code and a second lock code to the user enable the user to deactivate the locking mechanism of the delivery location apparatus to place the locking mechanism into an unlocked position before removing the parcel from the line of sight of the parcel detecting sensor. The removal of the parcel from the line of sight of the parcel detecting sensor while the locking mechanism is in the unlocked position does not triggers the alarm.

In another aspect, the lock code and the unlock code are the same code.

In another aspect, the unlock code is a code selected by the user.

In another aspect, the alarm triggered by the removal of the parcel from the line of sight of the parcel detecting sensor while the locking mechanism is in the locked position is selected from the group consisting of an audible alarm, an activation of a light source, an alert transmitted to the seller of the item, an alert sent to authorities, an alert sent to a service, and an alert sent to the person associated with the delivery location apparatus.

In another aspect, the memory coupled to the one or more processors and storing program instructions that when executed by the one or more processors further cause the one or more processors to send a notification to the user when the person delivering the parcel to the delivery location apparatus activates the locking mechanism of the delivery location apparatus after placing the parcel in the line of sight of the parcel detecting sensor.

In another aspect, the memory coupled to the one or more processors and storing program instructions that when executed by the one or more processors further cause the one or more processors to send a notification to the user on retrieval of the parcel.

In another aspect, the notification is sent to a user's mobile device.

In another aspect, the deactivation of the locking mechanism of the delivery location apparatus to place the locking mechanism into an unlocked position before removing the parcel from the line of sight of the parcel detecting sensor is performed with a user's mobile device. In another aspect, the memory coupled to the one or more processors and storing program instructions that when executed by the one or more processors further cause the one or more processors to send a message to a user's mobile device which instructs the user to respond to the message when the user is at the delivery location apparatus and ready to retrieve the item.

In another aspect, the lock code is wirelessly entered into the delivery parcel theft prevention system from a mobile computing device.

In another aspect, a porch piracy delivered parcel theft prevention system includes a delivery location apparatus that is associated with and configured to be attached to a building to receive a parcel, the delivery location apparatus and a computing system implementing an order planning system. The delivery location apparatus includes a parcel detecting sensor, a parcel detected locking mechanism, a controller and a mounting mechanism. The parcel detecting sensor is configured to detect a parcel when the parcel is placed in a line of sight of the parcel detecting sensor. The parcel detected locking mechanism is configured to trigger an alarm when, in a locked position, the parcel detected locking mechanism detects removal of the parcel placed in the line of sight of the parcel detecting sensor. The controller is configured to control the parcel detected locking mechanism and includes an input device. The mounting mechanism is configured to attach the delivery location apparatus to an outside surface of the building to enable a user to retrieve an item from the line of sight of the parcel detecting sensor while the user is at the delivery location; The computing system implementing an order planning system includes one or more processors and a memory coupled to the one or more processors. The memory stores program instructions that when executed by the one or more processors cause the one or more processors to at least: receive from a user a selection of an item; identify a delivery location apparatus that the user has associated with the selection of the item; associate the delivery of the item with the delivery location apparatus so that the item will be delivered to the delivery location apparatus adapted to the building to enable the user to go to the delivery location and to remove the item from the line of sight of the parcel detecting sensor while the user is at the delivery location; and provide a first lock code and a second lock code to enable the person delivering the parcel to the delivery location apparatus to activate the locking mechanism of the delivery location apparatus after placing the parcel in the line of sight of the parcel detecting sensor. The controller of the delivery location apparatus, in response to a receipt of the first lock code and the second lock code from the person delivering the parcel to the delivery location apparatus after placing the parcel in the line of sight of the parcel detecting sensor, controls the locking mechanism to activate the locking mechanism of the delivery location apparatus to place the locking mechanism into a locked position. The removal of the parcel from the line of sight of the parcel detecting sensor while the locking mechanism is in the locked position triggers an alarm.

In another aspect, a method for preventing porch piracy delivered parcel theft, comprising the steps of: attaching a delivery location apparatus to a building to receive a parcel, the delivery location apparatus, and implementing an order planning system on a computing system, the computing system performing the steps of at least: receiving from a user a selection of an item; identifying a delivery location apparatus that the user has associated with the selection of the item; associating the delivery of the item with the delivery location apparatus so that the item will be delivered to the delivery location apparatus adapted to the building to enable the user to go to the delivery location and to remove the item from the line of sight of the parcel detecting sensor while the user is at the delivery location; and providing a lock code to enable the person delivering the parcel to the delivery location apparatus to activate the locking mechanism of the delivery location apparatus after placing the parcel in the line of sight of the parcel detecting sensor; receiving the lock code from the person delivering the parcel to the delivery location apparatus after placing the parcel in the line of sight of the parcel detecting sensor, activating the locking mechanism to place the locking mechanism into a locked position; and triggering an alarm when the parcel is removed from the line of sight of the parcel detecting sensor while the locking mechanism is in the locked position. The delivery location apparatus attached to the building to receive a parcel, the delivery location apparatus includes a parcel detecting sensor, a parcel detected locking mechanism, a controller, and a mounting mechanism. The parcel detecting sensor is configured to detect a parcel when the parcel is placed in a line of sight of the parcel detecting sensor. The parcel detected locking mechanism is configured to trigger an alarm when, in a locked position, the parcel detected locking mechanism detects removal of the parcel placed in the line of sight of the parcel detecting sensor; the controller is configured to control the parcel detected locking mechanism, the controller comprising an input device; and the mounting mechanism is configured to attach the delivery location apparatus to an outside surface of the building to enable a user to retrieve an item from the line of sight of the parcel detecting sensor while the user is at the delivery location In another aspect, the method includes the step of wirelessly entering into the delivery parcel theft prevention system from a mobile computing device.

In another aspect, the method includes the step of manually entering the lock into the delivery parcel theft prevention system via the input device.

In another aspect, the method includes the step of providing an unlock code to the user enable the user to deactivate the locking mechanism of the delivery location apparatus to place the locking mechanism into an unlocked position before removing the parcel from the line of sight of the parcel detecting sensor; and not triggering the alarm upon removal of the parcel from the line of sight of the parcel detecting sensor while the locking mechanism is in the unlocked position.

In another aspect, the lock code and the unlock code used in the method are the same code.

In another aspect, the unlock code used in the method is a code selected by the user.

In another aspect, the alarm triggered by the removal of the parcel from the line of sight of the parcel detecting sensor while the locking mechanism is in the locked position is selected from the group a step taken from the group of steps of: sounding an audible alarm, activating a light source, transmitting an alert transmitted to the seller of the item, transmitting an alert to authorities, transmitting an alert to a service, and transmitting an alert to the person associated with the delivery location apparatus.

In another aspect, the method includes the step of sending a notification to the user when the person delivering the parcel to the delivery location apparatus activates the locking mechanism of the delivery location apparatus after placing the parcel in the line of sight of the parcel detecting sensor.

In another aspect, the method includes the step of sending a notification to the user on retrieval of the parcel In another aspect, the method includes the step of sending the notification to a user's mobile device.

In another aspect, the method includes the step of deactivating the locking mechanism of the delivery location apparatus to place the locking mechanism into an unlocked position before removing the parcel from the line of sight of the parcel detecting sensor with a user's mobile device.

In another aspect, the method includes the step of sending a message to a user's mobile device and which instructs the user to respond to the message when the user is at the delivery location apparatus and ready to retrieve the item.

While this disclosure has been described in connection with specific embodiments, it is evident that numerous alternatives, modifications, and variations will be apparent to those skilled in the art within the spirit and scope of the above disclosure.

What is claimed is:

1. A porch piracy delivered parcel theft prevention system, comprising:

a delivery location apparatus configured for attachment to a building and for communication with a computing system implementing an order planning system, the delivery location apparatus comprising:

a parcel detecting sensor, the parcel detecting sensor configured to detect a parcel when the parcel is placed in a line of sight of the parcel detecting sensor;

a parcel detected locking mechanism, the parcel detected locking mechanism configured to trigger an alarm when, in a locked position, the parcel detected locking mechanism detects removal of the parcel placed in the line of sight of the parcel detecting sensor;

a controller configured to control the parcel detected locking mechanism, the controller comprising a processor;

the computing system comprising:

one or more processors; and a memory coupled to the one or more processors and storing program instructions that when executed by the one or more processors cause the one or more processors to at least:

receive from a user a selection of an item to be parcel delivered;

identify a delivery location apparatus that the user has associated with the selection of the item to be parcel delivered;

associate the delivery of the item to be parcel delivered with the delivery location apparatus so that a parcel of the item to be parcel delivered will be delivered to the delivery location apparatus; and provide a lock code to enable a person delivering the parcel of the item to be parcel delivered to the delivery location apparatus to activate the locking mechanism of the delivery location apparatus after placing the parcel of the item to be parcel delivered in the line of sight of the parcel detecting sensor;

wherein the processor of the delivery location apparatus, in response to a receipt of the lock code from the person delivering the parcel of the item to be parcel delivered to the delivery location apparatus after placing the parcel of the item to be parcel delivered in the line of sight of the parcel detecting sensor, controls the locking mechanism to activate the locking mechanism of the delivery location apparatus to place the locking mechanism into a locked position; and wherein removal of the parcel of the item to be parcel delivered from the line of sight of the parcel detecting sensor while the locking mechanism is in the locked position triggers an alarm.

2. The porch piracy delivered parcel theft prevention system of claim 1 wherein the lock code is wirelessly entered into the porch piracy delivered parcel theft prevention system from a mobile computing device.

3. The porch piracy delivered parcel theft prevention system of claim 1 wherein the controller further comprises an input device and wherein the lock code is manually entered into the porch piracy delivered parcel theft prevention system via the input device.

4. The porch piracy delivered parcel theft prevention system of claim 1 wherein the controller further comprises an input device and wherein the input device is a touch sensitive screen attached to the building in proximity to the parcel detecting sensor.

5. The porch piracy delivered parcel theft prevention system of claim 1 wherein the memory coupled to the one or more processors and storing program instructions that when executed by the one or more processors further cause the one or more processors to:

provide an unlock code to the user to enable the user to deactivate the locking mechanism of the delivery location apparatus to place the locking mechanism into an unlocked position before removing the parcel of the item to be parcel delivered from the line of sight of the parcel detecting sensor;

wherein removal of the parcel of the item to be parcel delivered from the line of sight of the parcel detecting sensor while the locking mechanism is in the unlocked position does not trigger the alarm.

6. The porch piracy delivered parcel theft prevention system of claim 1 wherein the alarm triggered by the removal of the parcel of the item to be parcel delivered from the line of sight of the parcel detecting sensor while the locking mechanism is in the locked position is selected from the group consisting of an audible alarm, an activation of a light source, an alert transmitted to the seller of the item to be parcel delivered, an alert sent to authorities, an alert sent to a service, and an alert sent to the person associated with the delivery location apparatus.

7. The porch piracy delivered parcel theft prevention system of claim 1 wherein the memory coupled to the one or more processors and storing program instructions that when executed by the one or more processors further cause the one or more processors to:

send a notification to the user when the person delivering the parcel of the item to be parcel delivered to the delivery location apparatus activates the locking mechanism of the delivery location apparatus after placing the parcel of the item to be parcel delivered in the line of sight of the parcel detecting sensor.

8. The porch piracy delivered parcel theft prevention system of claim 5 wherein the deactivation of the locking mechanism of the delivery location apparatus to place the locking mechanism into an unlocked position before removing the parcel of the item to be parcel delivered from the line of sight of the parcel detecting sensor is performed with a mobile device.

9. A porch piracy delivered parcel theft prevention system, comprising:

a computing system implementing an order planning system configured for communication with a delivery location apparatus the delivery location apparatus configured for attachment to a building, the delivery location apparatus comprising:

a parcel detecting sensor, the parcel detecting sensor configured to detect a parcel when the parcel is placed in a line of sight of the parcel detecting sensor;

a parcel detected locking mechanism, the parcel detected locking mechanism configured to trigger an alarm when, in a locked position, the parcel detected locking mechanism detects removal of the parcel placed in the line of sight of the parcel detecting sensor; and a controller configured to control the parcel detected locking mechanism, the controller comprising a processor; and the computing system comprising:

one or more processors; and a memory coupled to the one or more processors and storing program instructions that when executed by the one or more processors cause the one or more processors to at least:

receive from a user a selection of an item to be parcel delivered;

identify a delivery location apparatus that the user has associated with the selection of the item to be parcel delivered;

associate the delivery of the item to be parcel delivered with the delivery location apparatus so that a parcel of the item to be parcel delivered will be delivered to the delivery location apparatus; and provide a lock code to enable a person delivering the parcel of the item to be parcel delivered to the delivery location apparatus to activate the locking mechanism of the delivery location apparatus after placing the parcel of the item to be parcel delivered in the line of sight of the parcel detecting sensor;

wherein the processor of the delivery location apparatus, in response to a receipt of the lock code from the person delivering the parcel of the item to be parcel delivered to the delivery location apparatus after placing the parcel of the item to be parcel delivered in the line of sight of the parcel detecting sensor, controls the locking mechanism to activate the locking mechanism of the delivery location apparatus to place the locking mechanism into a locked position; and wherein removal of the parcel of the item to be parcel delivered from the line of sight of the parcel detecting sensor while the locking mechanism is in the locked position triggers an alarm.

10. A method for preventing porch piracy delivered parcel theft, comprising the steps of:

implementing an order planning system on a computing system configured for communication with a delivery location apparatus configured for attachment to a building, the delivery location apparatus comprising:

a parcel detecting sensor, the parcel detecting sensor configured to detect a parcel when the parcel is placed in a line of sight of the parcel detecting sensor;

a parcel detected locking mechanism, the parcel detected locking mechanism configured to trigger an alarm when, in a locked position, the parcel detected locking mechanism detects removal of the parcel placed in the line of sight of the parcel detecting sensor;

a controller configured to control the parcel detected locking mechanism;

the computing system performing the steps of at least:

receiving from a user a selection of an item to be parcel delivered;

identifying a delivery location apparatus that the user has associated with the selection of the item to be parcel delivered;

associating the delivery of the item to be parcel delivered with the delivery location apparatus so that the item to be parcel delivered will be delivered to the delivery location apparatus; and providing a lock code to enable a person delivering a parcel of the item to be parcel delivered to the delivery location apparatus to activate the locking mechanism of the delivery location apparatus after placing the parcel of the item to be parcel delivered in the line of sight of the parcel detecting sensor;

entering the lock code into the delivery location apparatus after placing the parcel of the item to be parcel delivered in the line of sight of the parcel detecting sensor to activate the locking mechanism to place the locking mechanism into a locked position; and triggering an alarm when the parcel of the item to be parcel delivered is removed from the line of sight of the parcel detecting sensor while the locking mechanism is in the locked position.

11. The porch piracy delivered parcel theft method of claim 10 further comprising the step of wirelessly communicating with the delivery location apparatus from a mobile computing device.

12. The porch piracy delivered parcel theft method of claim 10 further comprising the step of manually entering the lock code into the delivery location apparatus via an input device.

13. The porch piracy delivered parcel theft method of claim 10 wherein the computing system performing the further steps of:

providing an unlock code to the user to enable the user to deactivate the locking mechanism of the delivery location apparatus to place the locking mechanism into an unlocked position before removing the parcel of the item to be parcel delivered from the line of sight of the parcel detecting sensor; and not triggering the alarm upon removal of the parcel of the item to be parcel delivered from the line of sight of the parcel detecting sensor while the locking mechanism is in the unlocked position.

14. The porch piracy delivered parcel theft method of claim 10, wherein the alarm triggered by the removal of the parcel of the item to be parcel delivered from the line of sight of the parcel detecting sensor while the locking mechanism is in the locked position is selected from the group of alarms consisting of: sounding an audible alarm, activating a light source, transmitting an alert transmitted to the seller of the item to be parcel delivered, transmitting an alert to authorities, transmitting an alert to a service, and transmitting an alert to the person associated with the delivery location apparatus.

15. The porch piracy delivered parcel theft method of claim 10, further comprising a step of:

sending a notification to the user when the person delivering the item to be parcel delivered to the delivery location apparatus activates the locking mechanism of the delivery location apparatus after placing the item to be parcel delivered in the line of sight of the parcel detecting sensor.

16. The porch piracy delivered parcel theft method of claim 10, further comprising a step of: sending a notification to the user on delivery of the parcel of the item to be parcel delivered.

17. The porch piracy delivered parcel theft method of claim 16 comprising the step of sending the notification to a mobile device.

18. The porch piracy delivered parcel theft method of claim 10 comprising the step of deactivating the locking mechanism of the delivery location apparatus to place the locking mechanism into an unlocked position before removing the parcel from the line of sight of the parcel detecting sensor with a mobile device.

19. The porch piracy delivered parcel theft method of claim 10 comprising the step of:

sending a message to a mobile device and which instructs the user to respond to the message when the user is at the delivery location apparatus and ready to retrieve the item to be parcel delivered.

20. The delivery location apparatus of claim 1 in combination with the computing system implementing an order planning system.

21. The delivery location apparatus of claim 5 wherein the lock code and the unlock code are the same.

22. The computing system implementing an order planning system of claim 9 in combination with the delivery location apparatus.

23. The porch piracy delivered parcel theft prevention system of claim 9 wherein the lock code is wirelessly entered into the delivery parcel theft prevention system from a mobile computing device.

24. The porch piracy delivered parcel theft prevention system of claim 9: wherein the controller further comprising an input device; and wherein the lock code is manually entered into the delivery parcel theft prevention system via the input device.

25. The porch piracy delivered parcel theft prevention system of claim 9:

wherein the memory coupled to the one or more processors and storing program instructions that when executed by the one or more processors further cause the one or more processors to:

provide an unlock code to the user to enable the user to deactivate the locking mechanism of the delivery location apparatus to place the locking mechanism into an unlocked position before removing the parcel of the item to be parcel delivered from the line of sight of the parcel detecting sensor;

wherein removal of the parcel of the item to be parcel delivered from the line of sight of the parcel detecting sensor while the locking mechanism is in the unlocked position does not trigger the alarm.

26. The porch piracy delivered parcel theft prevention system of claim 9 wherein the memory coupled to the one or more processors and storing program instructions that when executed by the one or more processors further cause the one or more processors to:

send a notification to the user when the person delivering the parcel of the item to be parcel delivered to the delivery location apparatus activates the locking mechanism of the delivery location apparatus after placing the parcel of the item to be parcel delivered in the line of sight of the parcel detecting sensor.

27. The porch piracy delivered parcel theft prevention system of claim 25 wherein the deactivation of the locking mechanism of the delivery location apparatus to place the locking mechanism into an unlocked position before removing the parcel of the item to be parcel delivered from the line of sight of the parcel detecting sensor is performed with a mobile device.

28. The delivery location apparatus of claim 25 wherein the lock code and the unlock code are the same.

29. The porch piracy delivered parcel theft method of claim 10 further comprising the step of combining the computing system implementing an order planning system with the delivery location apparatus.

30. The porch piracy delivered parcel theft method of claim 10 further comprising the step of deactivating the locking mechanism of the delivery location apparatus to place the locking mechanism into an unlocked position before removing the parcel from the line of sight of the parcel detecting sensor.

31. The porch piracy delivered parcel theft method of claim 10 further comprising the step of wireless entering the lock code into the delivery location apparatus.

32. A porch piracy delivered parcel theft prevention system, comprising:

a delivery location apparatus associated with and configured for attachment to a building, the delivery location apparatus comprising:

a parcel detecting sensor, the parcel detecting sensor configured to detect a parcel of an item to be parcel delivered when the parcel of an item to be parcel delivered is placed in a line of sight of the parcel detecting sensor;

a parcel detected locking mechanism, the parcel detected locking mechanism configured to trigger an alarm when, in a locked position, the parcel detected locking mechanism detects removal of the parcel of an item to be parcel delivered placed in the line of sight of the parcel detecting sensor;

a controller configured to control the parcel detected locking mechanism, the controller comprising a processor;

a memory coupled to the controller and storing program instructions that when executed by the controller causes the processor to at least:

arm the parcel detected locking mechanism upon entry of a carrier code;

disarm the parcel detected locking mechanism upon entry of a user code;

wherein when armed, the parcel detected locking mechanism is configured to trigger an alarm when the parcel detected locking mechanism detects removal of the parcel of an item to be parcel delivered from the line of sight of the parcel detecting sensor; and wherein when disarmed, the parcel of an item to be parcel delivered may be removed from the line of sight of the parcel detecting sensor without tripping the alarm.

33. The porch piracy delivered parcel theft prevention system of claim 32 wherein the carrier code and the user code are the same.

34. The porch piracy delivered parcel theft prevention system of claim 32 wherein the carrier code is wirelessly entered into the porch piracy delivered theft prevention system from a mobile computing device.

35. The porch piracy delivered parcel theft prevention system of claim 32:

wherein the controller further comprising an input device;

wherein the carrier code is manually entered into the porch piracy delivered parcel theft prevention system via the input device.

36. The porch piracy delivered parcel theft prevention system of claim 32:

wherein the controller further comprising an input device; and wherein the input device is a touch sensitive screen attached to the building in proximity to the parcel detecting sensor.

37. The porch piracy delivered parcel theft prevention system of claim 32 further comprising a computing system implementing an order planning system.

38. The porch piracy delivered parcel theft prevention system of claim 37 wherein the computing system:

receiving from a user a selection of an item to be parcel delivered;

identifying a delivery location apparatus that the user has associated with the selection of the item to be parcel delivered;

associating the delivery of the item to be parcel delivered with the delivery location apparatus so that a parcel of the item to be parcel delivered will be delivered to the delivery location apparatus; and providing the carrier code and the user code.

* * * * *